US007384719B2

(12) United States Patent
Yamashita et al.

(10) Patent No.: US 7,384,719 B2
(45) Date of Patent: Jun. 10, 2008

(54) CARRIER, DEVELOPER INCLUDING THE CARRIER, AND IMAGE FORMING APPARATUS USING THE DEVELOPER

(75) Inventors: Masahide Yamashita, Tokyo (JP); Tomio Kondou, Numazu (JP); Kousuke Suzuki, Numazu (JP)

(73) Assignee: Ricoh Company Ltd., Tokyo (JP)

( * ) Notice: Subject to any disclaimer, the term of this patent is extended or adjusted under 35 U.S.C. 154(b) by 363 days.

(21) Appl. No.: 11/068,835

(22) Filed: Mar. 2, 2005

(65) Prior Publication Data

US 2005/0238980 A1 Oct. 27, 2005

(30) Foreign Application Priority Data

Mar. 2, 2004 (JP) ..... 2004-057462

(51) Int. Cl.
*G03G 9/113* (2006.01)

(52) U.S. Cl. ..... 430/108.1; 430/111.35; 430/111.41

(58) Field of Classification Search ..... 430/108.1, 430/111.35, 111.41
See application file for complete search history.

(56) References Cited

U.S. PATENT DOCUMENTS

| | | | | |
|---|---|---|---|---|
| 6,106,987 | A * | 8/2000 | Hakata et al. | 430/111.35 |
| 6,406,826 | B1 | 6/2002 | Suzuki et al. | |
| 6,485,877 | B2 * | 11/2002 | Hakata | 430/111.35 |
| 6,500,595 | B1 | 12/2002 | Mochizuki et al. | |
| 6,743,558 | B2 | 6/2004 | Yamaguchi et al. | |
| 2004/0234876 | A1 | 11/2004 | Suzuki et al. | |
| 2004/0253528 | A1 * | 12/2004 | Yamashita et al. | 430/111.35 |

FOREIGN PATENT DOCUMENTS

| | | |
|---|---|---|
| JP | 54-155048 | 12/1979 |
| JP | 57-040267 | 3/1982 |
| JP | 58-108548 | 6/1983 |
| JP | 58-108549 | 6/1983 |
| JP | 59-166968 | 9/1984 |
| JP | 62-262057 | 11/1987 |
| JP | 64-019584 | 1/1989 |
| JP | 02-079862 | 3/1990 |
| JP | 05-216282 | 8/1993 |
| JP | 05-273789 | 10/1993 |
| JP | 06-202381 | 7/1994 |
| JP | 08-006307 | 1/1996 |
| JP | 08-006308 | 1/1996 |
| JP | 09-269614 | 10/1997 |
| JP | 09-311504 | 12/1997 |
| JP | 09-319161 | 12/1997 |
| JP | 10-198078 | 7/1998 |
| JP | 10-239913 | 9/1998 |
| JP | 2000-162827 | 6/2000 |
| JP | 2000-172020 | 6/2000 |
| JP | 2001-117287 | 4/2001 |
| JP | 2001-117288 | 4/2001 |
| JP | 2001-188388 | 7/2001 |
| JP | 2001-272826 | 10/2001 |
| JP | 2002-229273 | 8/2002 |
| JP | 2002-287431 | 10/2002 |
| JP | 2003-140391 | 5/2003 |
| JP | 2003-167384 | 6/2003 |
| JP | 2003-280283 | 10/2003 |
| JP | 2003-280284 | 10/2003 |

OTHER PUBLICATIONS

U.S Appl. No. 11/870,613, filed Oct. 11, 2007, Iwatsuki et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A carrier composition, including a particulate magnetic material; and a layer located on a surface of the particulate magnetic material, wherein the layer is formed by heating a mixture containing a metal alkoxide; a resin having a hydroxyl group reacting with the metal alkoxide; and a particulate inorganic material.

22 Claims, 4 Drawing Sheets

CARRIER, DEVELOPER INCLUDING THE CARRIER, AND IMAGE FORMING APPARATUS USING THE DEVELOPER

BACKGROUND OF THE INVENTION

1. Field of the Invention

The present invention relates to a carrier providing a charge to a toner by frictionizing the toner, a developer including the carrier and a toner, and a process cartridge and an image forming apparatus using the developer.

2. Discussion of the Background

An electrophotographic image forming method typically forms an electrostatic latent image on a photoconductive image bearer; provides a charged toner to the electrostatic latent image to form a visual image; transfers the visual toner image onto a transfer medium such as papers; and fixes the visual toner image on the transfer medium with a heat, a pressure or a solvent vapor, etc.

The electrophotographic image forming method is broadly classified to a two-component developing method wherein a toner is charged by mixing the toner with a carrier and a one-component developing method wherein a toner is charged without using a carrier.

The one-component developing method is broadly classified to a magnetic developing method and a non-magnetic developing method according to whether a toner is magnetically borne by a developing roller.

Conventionally, the two-component developing method which has good charge stability and build ability of the toner and stably produces quality images for long periods is mostly used for printers, copiers and complex machines which are required to have high-speed printability and quality image reproducibility; and the one-component developing method is mostly used for small printers and facsimiles which are required to be space-saving and low-cost.

Recently in particular, color images are produced more, and therefore high-quality images and stability of image quality are demanded more than ever.

The two-component developing method stably produces good images by mixing and stirring a toner and a carrier to charge them as mentioned above, but the carrier deteriorates and a mixing ratio between the toner and carrier varies. Since the mixing ratio between the toner and carrier, i.e., a toner concentration affects image density, the toner needs to be supplied as needed to produce stable images. Further, when the toner and carrier are mixed and stirred, a pressure is applied thereto, and therefore a surface of the particulate carrier is abraded and the toner is spent thereon, which cause deterioration and instability of friction chargeability of the carrier, resulting in deterioration of image density and quality.

In addition, recently, both copiers and printers are required to save space, and to meet this requirement, a toner including a release agent is used in many cases because a fixer becomes small by saving a fixing oil and applying a small amount thereof. The release agent on the surface of the toner tends to be spent on the carrier.

In addition, since a toner having a small particle diameter has a large specific surface area, a surface energy thereof increases and the toner tends to adhere to neighboring materials, resulting in deterioration of fluidity thereof. When the fluidity of the toner deteriorates, the toner is not smoothly supplied to an image developer, and is not fully mixed with the carrier to sufficiently be charged. Therefore, a large amount of a fluidizer is added to the toner to impart fluidity, and further to impart mixability thereto to be uniformly mixed with the carrier in a short time. When the amount of the fluidizer is large, an existential status thereof changes as time passes, resulting in variation of the fluidity and frictional charge quantity of the toner and carrier.

In addition, a particulate inorganic material is often used as the fluidizer, and such a particulate material abrades other contact members, resulting in acceleration of abrasion of a coated layer of the carrier.

Therefore, the following technologies are disclosed to protect a photoreceptor from being damaged or abraded by the fluidizer, and to control charge polarity and charge quantity thereof.

For example, Japanese Laid-Open Patent Publication No. 2-131250 discloses a two-component developer comprising a carrier and a toner, wherein the carrier has a ceramic coating of a specific metal alkoxide, having a thickness of from 0.05 to 5 μm.

Japanese Laid-Open Patent Publication No. 7-295303 discloses a coating agent for an electrophotographic carrier, including a specific organopolysiloxane.

Japanese Laid-Open Patent Publications Nos. 7-181743 and 7-181744 disclose an electrophotographic carrier coated and hardened with a partial hydrolysis sol formed of at least one of Si alkoxide, Ti alkoxide, Al alkoxide and Zr alkoxide.

Japanese Laid-Open Patent Publication No. 7-181745 discloses an electrophotographic carrier coated and hardened with a partial hydrolysis sol formed of at least one of Si alkoxide, Ti alkoxide, Al alkoxide and Zr alkoxide, and including an inorganic oxide powder having an average particle diameter of from 1 to 100 nm and a hydroxyl group on a surface thereof.

Japanese Laid-Open Patent Publication No. 8-006309 discloses a carrier for developing an electrostatic latent image, having a metal oxide layer including at least one of aluminum, magnesium, zinc and lead on a core material.

Japanese Laid-Open Patent Publication No. 8-030039 discloses a carrier for developing an electrostatic latent image, wherein a particulate core material is coated with a metal oxide formed by a sol-gel method.

Japanese Laid-Open Patent Publication No. 11-202561 discloses a coating agent for a charging member, including a product from a reaction at a specific ratio between a silicone resin having a specific composition and an acrylic resin polymerized with at least one radical polymerizing vinyl monomer as a main component.

Japanese Laid-Open Patent Publication No. 2000-172020 discloses a carrier particles including a chemical compound selected from the group consisting of monomeric polyfunctional organosilanes, hydrolyzates of monomeric polyfunctional organosilanes, reaction products of monomeric polyfunctional organosilanes and heteroatom-containing organosilanes, wherein the reaction products of monomeric polyfunctional organosilanes and alkoxides further includes 5-50 wt. % silicon atom-free polymeric compound.

Japanese Laid-Open Patent Publication No. 2000-162827 discloses a magnetic carrier for an electrophotographic developer, formed of a particulate magnetic powder having an average particle diameter of from 10 to 200 μm including a particulate magnetic core material coated with a resin composition formed of a metallic hardener, a silane coupling oligomer and a silicone resin.

Japanese Laid-Open Patent Publication No. 2001-272826 discloses an electrophotographic carrier prepared by applying the following coating agent on a surface of a core material comprising a magnetic material. The coating agent includes a composite material produced from an organic compound having two or more functional groups, a compound and/or its hydrolyzed condensed product and a compound having a functional group which can react with the functional group of the organic compound and having a functional group which can react with the compound. The composite material consists of two or more kinds of composite components having different contents of nonvolatile components measured by the weight reduction by heating at 900° C. in air.

On the other hand, when a toner has a smaller particle diameter, the toner has a larger specific surface area. Although a charge quantity of the toner per unit area does not change, a charge quantity thereof per unit volume increases in terms of results.

A toner quantity forming an image depends on a toner quantity according to a latent image formed on an image bearer. Therefore, when a charge quantity of the toner per unit volume is too large, a sufficient toner quantity to form an image cannot be prepared and higher image quality with a toner having a small particle diameter is not always realized.

To secure a sufficient toner quantity on the image bearer, there is a method of enlarging a contrast of the latent image. However, in this case, the image bearer needs to have a sufficiently large charge potential, which tends to be disadvantageous in terms of consumed energy, temporal stability and electrostatic fatigue.

The above-mentioned technologies improving surface strength of the carrier and preventing a spent toner thereon cannot be expected at all to have effects on increase of charge quantity of the toner having a smaller particle diameter.

Besides, (1) abrasion of a surface of a carrier, (2) peeling of a surface coated layer of a carrier, (3) breakup of a carrier and (4) toner constituents adhered (spent) onto a carrier cause deterioration of chargeability, gradation from a desired electrical resistance, and tips and abrasion powders of foreign particles, resulting in deterioration of image density and image resolution, foggy background, physical/electrical damage to an image bearer and durability of the carrier. To solve these problems, various suggestions have been made in terms of materials for the carrier.

However, the suggestions cannot be expected to have sufficient effects in an environment wherein a fixing temperature is further lowered and a carrier is expected to have a longer life.

For examples, in Japanese Laid-Open Patent Publications Nos. 8-6308, 9-269614, 9-311504 and 10-239913, a matrix resin alone covers almost all the surface of a carrier, and therefore prevention of adherence of a toner mostly depends on a coverage of the matrix resin over the carrier and sufficient spent prevention is not always activated. When a toner capable of having a low-temperature fixability is used, in a method disclosed in Japanese Laid-Open Patent Publication No. 10-198078, a part of the carrier, having the same component as that of the binder resin of a toner, tends to a base the toner particles adhere to and the toner occasionally has a low charge quantity.

In addition, it has been suggested many times that a silicone resin having comparatively a low surface energy is coated on a carrier. However, the silicone resin does not adhere to a core material of the carrier well due to its low surface energy.

Besides, Japanese Laid-Open Patent Publication No. 58-108548 discloses a carrier coated with a specific resin material, Japanese Laid-Open Patent Publications Nos. 54-155048, 57-40267, 58-108549, 59-166968 and 6-202381, and Japanese Patent Publication No. 1-19584 disclose a carrier coated with a specific resin material further including various additives, and Japanese Patent No. 3120460 discloses a carrier coated with a specific resin material, which an additive adheres to. Japanese Laid-Open Patent Publication No. 8-6307 discloses that a benzoguanamine-n-butylalcohol-formaldehyde copolymer is used as a main component of a carrier coating material, and Japanese Patent No. 2683624 discloses that a crosslinked product between a melamine resin and an acrylic resin is used as a carrier coating material. Still, these carriers do not have sufficient durability.

Japanese Laid-Open Patent Publications Nos. 2001-117287, 2001-117288 and 2001-188388 disclose that a thermoplastic resin is used as a coating resin, and a coated layer including a particulate material larger than a thickness of a binder resin.

Japanese Laid-Open Patent Publication No. 9-319161 discloses a method of dispersing a specific thermosetting particulate resin in a matrix resin, wherein a carrier has a coated layer having a property equivalent to that of the initial coated layer even after abraded. However, the abrasion itself is not sufficiently decreased. Japanese Patent No. 2998633 discloses a method of dispersing an electroconductive particulate powder together with the specific thermosetting particulate resin in a matrix resin. However, the abrasion itself is not sufficiently decreased, either.

Because of these reasons, a need exists for a carrier suitable for producing high-quality images, having stable properties without overcharging a toner for long periods.

SUMMARY OF THE INVENTION

Accordingly, an object of the present invention is to provide a carrier suitable for producing high-quality images, having stable properties without overcharging a toner for long periods.

Another object of the present invention is to provide a two-component developer including the carrier.

A further object of the present invention is to provide a process cartridge and an image forming apparatus using the carrier or the two-component developer.

These objects and other objects of the present invention, either individually or collectively, have been satisfied by the discovery of a carrier comprising a particulate magnetic material; and a layer located on a surface of the particulate magnetic material, wherein the layer comprises a composition formed by heating a mixture comprising a metal alkoxide; a resin having a hydroxyl group reacting with the metal alkoxide; and a particulate inorganic material.

In addition, the metal alkoxide preferably includes aluminum and/or titanium.

Further, the resin having a hydroxyl group preferably includes hydroxyalkyl acrylate and/or hydroxyalkyl methacrylate.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
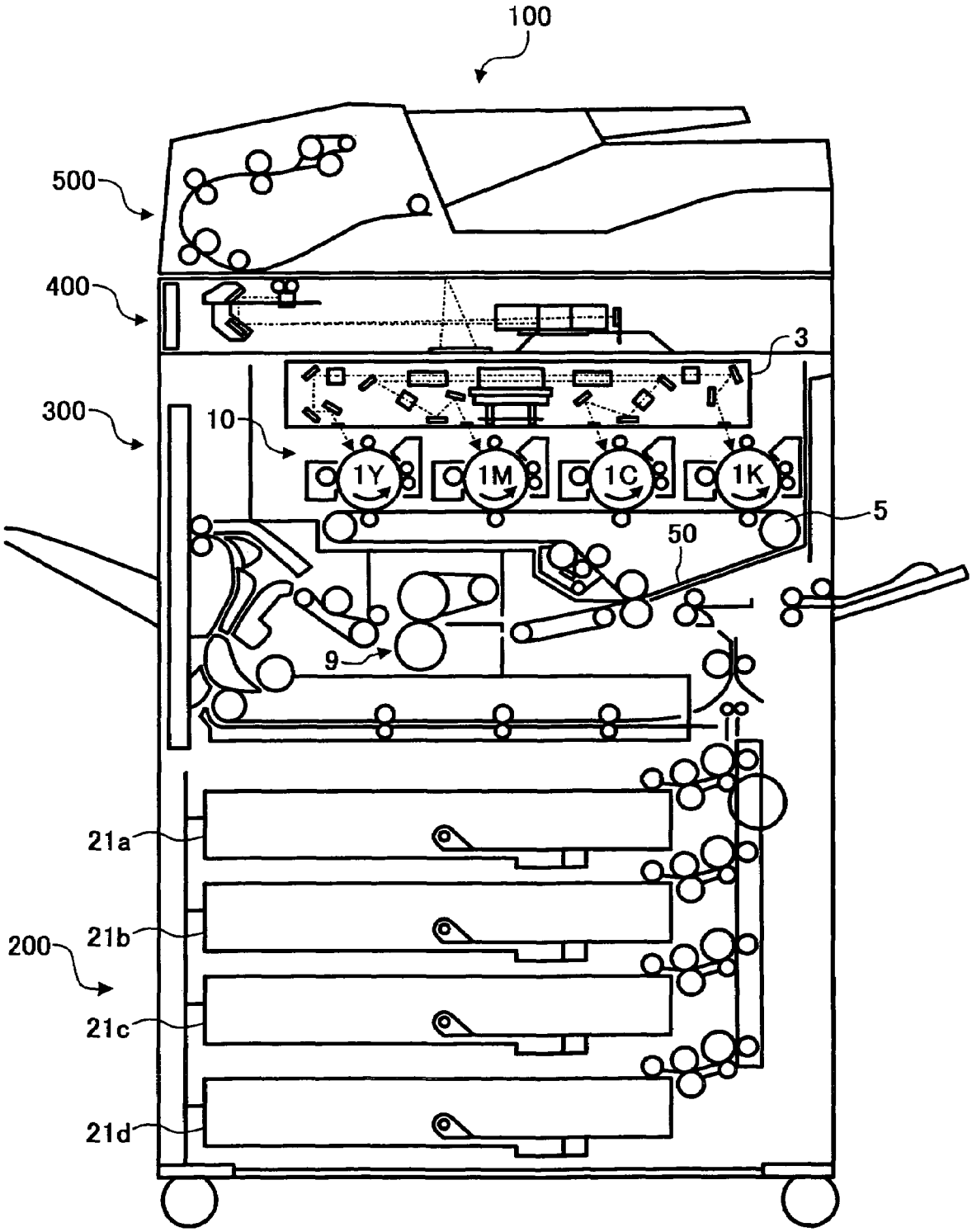
FIG. 1 is a perspective view illustrating an embodiment of the image forming apparatus of the present invention.

The present invention provides a carrier suitable for producing high-quality images, having stable properties without overcharging a toner for long periods, most-preferably all of these characteristics.

More particularly, the present invention relates to a carrier comprising a particulate magnetic material; and a layer located on a surface of the particulate magnetic material, wherein the layer comprises a composition formed by heating a mixture comprising a metal alkoxide; a resin having a hydroxyl group reacting with the metal alkoxide; and a particulate inorganic material.

As a result of continued studies of the present inventors to solve the problems of the above-mentioned conventional technologies, they discovered that a carrier comprising a particulate magnetic material; and a layer located on a surface of the particulate magnetic material, wherein the layer comprises a composition formed by heating a mixture comprising a metal alkoxide; a resin having a hydroxyl group reacting with the metal alkoxide; and a particulate inorganic material, noticeably prevents a toner to be negatively charged from being overcharged and is suitable for producing high-quality images with a toner having a small particle diameter or a toner including many external additives.

This is assumed to be as follows.

A toner in a two-component developer is charged by a friction, a contact and separation or a rolling between the toner and a carrier, wherein the toner is most stably and uniformly charged and a charge quantity thereof can be measured at a specific unit weight and or unit surface area. The toner is mostly charged at its surface or a vicinity thereof because of being formed mostly of an insulative resin. As analogized from a capacity of a conventional condenser, a charge borne by a unit area of the toner has a limit and the toner has a larger specific surface area. Namely, when the toner has a smaller particle diameter, a maximum charge quantity thereof at a unit weight becomes larger. Similarly, when an amount of an external additive having far smaller particle diameter than the toner increases, the external additive itself is charged and the toner is overcharged.

Therefore, the carrier needs to have a surface capable of controlling giving and receiving a charge when contacting the toner and external additive.

The metal alkoxide is typically hydrolyzed, and condensed and dehydrated with an atmospheric moisture to be a microscopic particulate metal oxide. When the particulate metal oxide is included alone in a coated layer of the carrier, they can uniformly be dispersed therein. Since the particulate metal oxide can change a charge sequence of the coated layer of the carrier, a charge quantity of the toner can be controlled to a certain degree by properly controlling a difference of the charge sequence between the carrier and toner.

However, since the particulate metal oxide produced from the metal alkoxide inevitably has a particle diameter distribution, a size thereof varies in the coated layer of the carrier, resulting in difficulty in precisely controlling a charge quantity of the toner.

The carrier of the present invention includes a coated layer obtained by heating a mixture including the metal alkoxide and a resin having a hydroxyl group reacting with the metal alkoxide. In the coated layer, a metal element of the metal alkoxide and the hydroxyl group of the resin are bonded and the metal element is thought to be present therein as uniformly as the resin.

Therefore, the capability of giving and receiving a charge of the carrier is thought to be determined only by chargeability of the metal element or a compound between the metal element and resin, and a quantity thereof as a whole without varying due to a size of cluster of a metal compound.

Accordingly, the charge quantity of the toner can precisely be controlled to have a required quantity.

In addition, the metal alkoxide and resin having a hydroxyl group reacting with the metal alkoxide form a crosslinked structure in the coated layer to improve strength thereof.

When the strength of the coated layer is improved, although the coated layer of the carrier varies less, a toner constituent adhered thereto, so-called spent toner, occasionally varies the chargeability of the carrier. In the present invention, since a particulate inorganic material included in the coated layer can scrape the spent toner on the surface of the carrier off, variation of the surface of the carrier having improved strength is highly prevented and the chargeability thereof can be stabilized for quite long periods.

Therefore, even a toner having a small particle diameter or a toner including many external additives has a stable charge quantity and produces high-quality images for long periods.

The metal alkoxide preferably includes aluminum and/or titanium.

In particular, the metal elements prevent a toner to negatively be charged from being overcharged, and a comparatively small amount thereof can control a charge quantity of the toner without having a negative effect on other required properties of the carrier.

Besides the aluminum and titanium, specific examples of the metal alkoxide include, but are not limited to, alkoxides including metal elements such as calcium, magnesium, silicon, beryllium, zinc, strontium, zirconium, vanadium.

Preferably at least one of methoxide, ethoxide, isopropoxide, butoxide is used as the alkoxide, but are not limited thereto.

The resin having a hydroxyl group preferably includes hydroxyalkyl acrylate and/or hydroxyalkyl methacrylate, and the hydroxyalkyl group more preferably includes 2 to 6 carbon atoms to maintain the proper crosslinked strength of the coated layer of the carrier and prevent the particulate inorganic material from leaving therefrom such that the coated layer has more abrasion resistance and spent resistance and variation of the carrier properties with time, such as chargeability and resistivity, is prevented.

When the resin having a hydroxyl group includes hydroxyalkyl acrylate and/or hydroxyalkyl methacrylate, and the hydroxyalkyl group includes 2 to 6 carbon atoms, weakness of the coated layer of the carrier can be prevented and the coated layer surely includes a metal element in the metal alkoxide. At the same time, variation of the surface of the carrier due to impact strength of stirring and friction can be prevented, and an overcharged toner to negatively be charged can be prevented similarly to the primary stage.

The molar concentration of the metal alkoxide in the coated layer of the carrier is preferably larger than that of the hydroxyl group of the resin having a hydroxyl group reacting with the metal alkoxide.

The hydroxyl group of the resin absorbs and desorbs an atmospheric moisture, and largely absorbs and desorbs an atmospheric moisture due to an environmental variation according to a hydrophobicity of the resin. In the present invention, since a metal element is taken in the coated resin, chemical absorption thereof can control an amount of absorbed and desorbed moisture to prevent an environmental variation of the properties of the carrier. Therefore, it is preferable that an amount of the metal element is larger than that of the hydroxyl group, and that the metal element not coordinating therewith is also present.

Besides the resin having a hydroxyl group, specific examples of the resin forming the coated layer of the carrier include, but are not particularly limited to, cross-linked copolymers such as polyolefin such as polyethylene and polypropylene and their modified resins, styrene, acrylicresins, acrylonitrile, vinylacetate, vinylalcohol, vinylcarbazole and vinylether; silicone resins formed of an organosiloxane bond or its modified resins by alkyd resins, polyester resins, epoxy resins, polyurethane, etc.; polyamide; polyester; polyurethane, polycarbonate; urea resins; melamine resins; benzoguanamine resins; epoxy resins; polyimide resins; and their derivatives.

Particularly, the resin in the coated layer preferably includes an acrylic section as a constitutional unit to reliably fix the insulative inorganic particles in the coat layer and to effectively prevent desorption thereof due to friction. The acrylic section in the coat layer can quite effectively prevent the desorption of the inorganic particles due to friction and can maintain the concavity and convexity on the surface of the carrier for long periods.

Further, the acrylic resin preferably has a glass transition temperature (Tg) of from 20 to 100° C., and more preferably from 25 to 80° C. The acrylic resin having a Tg in the above-mentioned range has a moderate elasticity, and it is considered that an impact the carrier receives when the developer is frictionally charged is decreased to prevent a damage of the coat layer.

Further, the mixture forming the resin in the coated layer preferably includes a silicone resin, providing a silicone section as a constitutional unit to decrease a surface energy of the carrier and prevent occurrence of the spent toner. Therefore, the carrier properties can be maintained for long periods.

The constitutional unit of the silicone section preferably includes a unit selected from the group consisting of methyltrisiloxane units, dimethyldisiloxane units and trimethylsiloxane units. The silicone potion may be chemically bonded or blended with the other resin in the coated layer.

When blended, silicone resins and/or its modified resins are preferably used. Particularly, a silicone resin composition which has a constitutional unit having the following formula (1) can prevent specific wear, abrasion and desorption of the silicone resin or other resins.

(1)

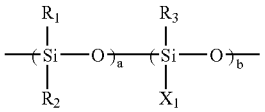

wherein $R_1$ to $R_3$ each, independently, represent a hydrocarbon group or a derivative thereof; $X_1$ represents a condensation reaction group; and a and b represent integers.

Specific examples of the silicone resins include any known silicone resins. Particularly, thermosetting silicone resins capable of having a three-dimensional network structure, straight silicone only formed of an organosiloxane bond having the following formula (2) and silicone resins modified by alkyd, polyester, epoxy urethane are preferably used:

(2)

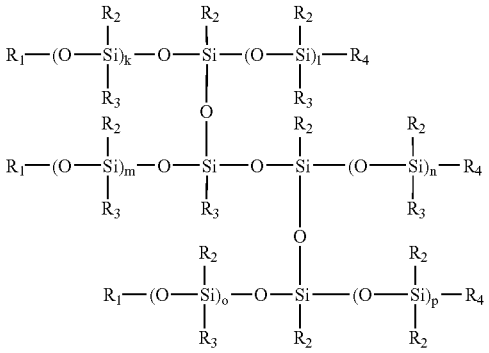

wherein $R_1$ represents a hydrogen atom, an alkyl group having 1 to 4 carbon atoms or a phenyl group; $R_2$ and $R_3$ independently represent a hydrogen atom, an alkoxy group having 1 to 4 carbon atoms, a phenyl group, a phenoxy group, an alkenyl group having 2 to 4 carbons atoms, an alkenyloxy group having 2 to 4 carbon atoms, a hydroxy group, a carboxyl group, an ethyleneoxide group, a glycidyl group or a group having the following formula (3):

(3)

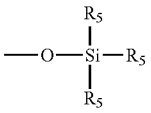

wherein $R_4$ and $R_5$ independently represent a hydroxy group, a carboxyl group, an alkyl group having 1 to 4 carbon atoms, an alkoxy group having 1 to 4 carbon atoms, an alkenyl group having 2 to 4 carbon atoms, an alkenyloxy group having 2 to 4 carbon atoms, a phenyl group and a phenoxy group; and k, l, m, n, o and p in formula (2) independently represent integers.

Each of the above-mentioned substituents may be unsubstituted and may have substituents such as a hydroxy group, a carboxyl group, an alkyl group, a phenyl group and a halogen atom.

Further, the particulate inorganic material included in the coated layer of the carrier is preferably alumina, titania, silica or their mixtures, which can prevent a variation of the chargeability of the carrier when an external additive included in a toner is slightly transferred to the surface of the carrier.

Besides alumina, titania, silica or their mixtures, an insulative particulate inorganic material is preferably used for the particulate inorganic material.

Specific examples of the insulative particulate inorganic material include, but not are limited to, known insulative powder particles such as aluminumoxide, siliconoxide, sodium carbonate, talc, clay, quartz glass, alumino silicate glass, mica chip, zirconium oxide, mullite, sialon, steatite, forsterite, cordierite, beryllium oxide and silicon nitride.

These may be subjected to a surface treatment using a dispersant, a fluidizer, an aggregation inhibitor, etc.

As mentioned above, the particulate inorganic material can remove the spent toner on the surface of the carrier, this is because the particulate inorganic material is thought to form concavities and convexities on the surface of the carrier.

The particulate inorganic material preferably has a weight-average particle diameter of from 0.15 to 2.0 μm to properly form the concavities and convexities on the surface of the carrier for removing the spent toner. When less than 0.15 μm, sufficient concavities and convexities are difficult to be formed. When greater than 2.0 μm, the particulate inorganic material tends to desorb and quality stability of the carrier is occasionally impaired.

The carrier preferably has a coated layer having a thickness of from 0.1 to 0.6 μm such that the concavities and convexities are stably formed and the particulate inorganic material is sufficiently maintained in the layer. When less than 0.1 μm, the particulate inorganic material is occasionally difficult to maintain. When greater than 0.6 μm, spaces among the particulate inorganic materials are fully occupied with a resin in the coated layer and the concavities and convexities for removing the spent toner are occasionally difficult to be formed.

To surely form the concavities and convexities on the surface of the carrier, a content of the particles is preferably from 20 to 90%, and more preferably from 25 to 80% by weight per 100% by weight of the constituents of the coat layer.

When the content of the particles is less than 20% by weight, the concavity and convexity on the surface of the carrier tends to be gentle and does not sufficiently scrape the spent toner occasionally. On the other hand, when the content of the particles is greater than 90%, the concavity and convexity tends to be brittle and the initial concavity and convexity cannot occasionally be maintained.

In addition, the weight-average particle diameter (D) of the particulate inorganic material included in the coated layer of the carrier and a thickness (h) of the coated layer preferably satisfy the following relationship:

$$1<D/h<10$$

When this is satisfied, the coated layer has moderate convexities, and when a developer is stirred to be frictionally charged, a contact to a binder resin with a strong impact is reduced in a friction with a toner or another carrier.

Therefore, the toner spent is more prevented, and an abrasion of the coated layer can be prevented. When D/h is 1 or less, the particles are buried in the binder resin, resulting in almost no effect of the particulate inorganic material.

When D/h is not less than 10, a binding force between the particles and the resin in the coated layer is insufficient because of a small contact area therebetween, and therefore the particles easily desorb.

The mixture used to form the coated layer preferably further includes conductive or semiconductive particles having a smaller number-average particle diameter than that of the particles forming surface concavities and convexities, typified by the above-mentioned insulative inorganic particles to precisely control the carrier resistance.

Known conductive or semiconductive particles can be used. Specific examples of the conductive particles include metals such as iron, gold and copper; iron oxide such as ferrite and magnetite; oxides such as bismuth oxide and molybdenum oxide; ionic conductors such as silver iodide and β-alumina; and pigments such as carbon black. Specific examples of the semiconductive particles include double oxides such as barium titanate, strontium titanate and lead lanthanum titanate; titaniumoxide; zincoxide;oxygen defect formations of tin oxide (Frenkel type semiconductors); and impurity type defect formations (Schottky type semiconductors).

Among these conductive or semiconductive particles, particularly a furnace black and an acetylene black are preferably used because even a small amount of low-resistance fine powders thereof can effectively control the conductivity.

The low-resistance fine powders need to be smaller than the particles forming surface concavities and convexities of a carrier, and preferably has a number-average particle diameter of from 0.01 to 1 μm and a content of from 2 to 30 parts by weight per 100 parts by weight of the resin in the coat layer.

Further, to control an electrostatic force applied to the carrier in development to reliably prevent the carrier adhesion and produce high-quality images, a resistivity R needs to be from $1.0\times10^{9}$ to $1.0\times10^{11}$ Ω·cm when a volt alternating current E determined by the following formula is applied at a frequency of 1,000 Hz to a magnetic brush of the carrier having a space occupancy of 40%, which is formed between parallel plate electrodes having a gap of d mm:

$$E(V)=250\times d$$

wherein d is 0.40±0.05 mm and E is a peak voltage.

As mentioned above, the carrier adhesion is caused by a balance between the magnetic binding force, and mechanical and electrostatic desorption. Therefore, to prevent the carrier adhesion, it is preferable that the carrier is electrostatically regulated in addition to the above-mentioned uniformity of its constituents, magnetic regulation and particle diameter regulation.

When the resistivity R is greater than $1.0\times10^{11}$ Ω·cm, a charge generated by frictionally charged toner and carrier due to an agitation of a developer is accumulated in the carrier particles and the carrier particles are drawn to an non-image forming section of an image bearer to cause the carrier adhesion.

When the resistivity R is less than $1.0\times10^{9}$ Ω·cm, the carrier particles have induced charges and the carrier adhesion occurs regardless of an image forming section or a non-image forming section.

Further, the carrier having a low resistivity disturbs an electrostatic latent image on an image bearer to impair high quality images.

In addition, when the coated layer includes a coupling agent having an amino group, an existential amount of a charge generating site due to a friction with a toner negatively charged can be controlled, and charging speed until the toner has a desired charge quantity can be increased.

Among the coupling agents, an amino silane coupling agent is preferably used.

Magnetic materials for use in the core material of the carrier are not particularly limited so long as they are in the specification of the present invention, and known materials, e.g., metals such as iron, cobalt and nickel; alloyed metals such as magnetite, hematite and ferrite; and other compounds can be used. However, the materials are not limited thereto.

The magnetic particles may be used in any forms of a single crystal/amorphous particles, a single/complex sintered body and particles including single/complex particles dispersed in a polymer such as resins. Particles including magnetic particles in a polymer preferably has the magnetic particles having a particle diameter of from 0.5 to 10 μm to balance magnetic properties of the carrier particles and dispersibility of the magnetic particles. Specific examples of resins including dispersed magnetic particles and forming a carrier core material include polyolefin resins such as polyethylene, polypropylene, chlorinated polyethylene and chlorosulfonated polyethylene; polyvinyl and polyvinylidene resins such as polystyrene, acrylic resins, e.g., polymethylmethacrylate, polyacrylonitrile, polyvinylacetate, polyvinylalcohol, polyvinylbutyral, polyvinylchloride, polyvinylcarbazole, polyvinylether and polyvinylketone; vinylchloride-vinylacetate copolymers; fluorocarbon resins such as polytetrafluoroethylene, polyfluorovinyl, polyfluorovinylidene and polychlorotrifluoroethylene; polyamide; polyester; polyurethane; polycarbonate, etc. However, the resins are not limited thereto.

Particles including core materials including dispersed magnetic materials may include a coupling agent such as silane coupling agents and titanate coupling agents as an auxiliary agent to improve adhesion of the magnetic materials and dispersibility of a resistance controlling agent.

In addition, the carrier preferably has a weight-average particle diameter (D4) of from 25 to 65 μm, and a content of the carrier having the weight-average particle diameter not greater than 22 μm is not greater than 1.0% by weight.

As mentioned above, the carrier preferably has a small particle diameter to produce high quality images. However, carrier particles having too small a particle diameter have a small magnetization and a small binding force individually. Therefore, the carrier needs to have a weight-average particle diameter (D4) of from 25 to 65 μm to prevent the carrier adhesion and produce high quality images. For the same reason, the carrier adhesion can reliably be prevented when a content of the carrier having the weight-average particle diameter not greater than 22 μm is not greater than 1.0% by weight.

Known methods can be used to form the coat layer, and a coating liquid for forming the coat layer can be coated on a surface of the core material particle by spray coating methods, dip coating methods, etc. The coat layer preferably has a thickness of from 0.01 to 20 μm, and more preferably from 0.3 to 10 μm.

The carrier particle on which the coat layer is formed is preferably heated to promote a polymerization reaction of the coat layer.

The carrier may be heated in a coating apparatus or other heating means such as ordinary electric ovens and sintered kiln after the coat layer is formed.

The heating temperature cannot be completely determined because it differs depending on a material for use in the coat layer, but a temperature of from 120 to 350° C. is preferably used. The heating temperature is preferably not greater than a decomposition temperature of a resin for use in the coat layer and preferably has an upper limit of 200° C.

In addition, a heating time is preferably from 5 to 120 min.

A developer including a toner to be negatively charged, comprising a binder resin and a colorant, and the above-mentioned carrier can prevent carrier adherence and produce high-quality images.

The toner preferably has a small particle diameter to form a high-definition and high-quality image. However, such a toner occasionally leaves from the carrier with a moderate air stream, and contaminates an image forming apparatus inside and adheres to a blank part of an image. Therefore, the toner preferably has a weight-average particle diameter of from 3 to 10 μm, and more preferably from 3 to 7 μm. Further, the toner preferably has a 10% cumulative particle diameter based on number standard of not less than 2.5 μm.

At the same time, the toner is preferably closer to be spherical to be uniformly charged and form a high-definition and high-quality image, and specifically, the toner preferably has an average circularity of from 0.93 to 1.00.

A toner having an average circularity not less than 0.93 has high transferability and produces high-quality images without image deterioration when transferred.

The circularity SR is defined as follows:

SR=a peripheral length of a circle having an area equivalent to that of a projected area of a particle/a peripheral length of a projected image of the particle The closer a toner to a true sphere, the closer the SR to 1. A toner having high sphericity tends to be affected by an electrical flux line on a carrier or a developing sleeve, and an electrostatic image is faithfully developed along the electrical flux line thereof. When a microscopic latent image dot is reproduced, the toner is minutely and uniformly located, which is less scattered between thin lines and has high reproducibility of the thin line images. When less than 0.93, the toner produces low-quality images has thin line reproducibility thereof deteriorated, resulting in difficulty of production of high-definition images.

Further, the toner preferably includes a fluidizer externally to uniformly be charged in a developer because the toner can quickly be rolled and dispersed therein.

The toner preferably includes the fluidizer in an amount of 0.5 to 3.0% by weight based on total weight of the toner.

As mentioned above, the toner having a small particle diameter has a large specific surface area and tends to agglutinate. Therefore, the toner preferably includes the fluidizer in an amount of not less than 0.5% by weight based on total weight of the toner to prevent the agglutination and maintain fluidity thereof.

The fluidizer occasionally increases the charge quantity of a toner. However, when used with the carrier of the present invention, the overcharged toner, particularly when the fluidizer increases due to increase of the specific surface area of the toner, can be prevented.

When the toner includes the fluidizer too much, a large amount of the free fluidizers contaminate the concave and convex surface of the carrier, and therefore the toner preferably includes the fluidizer in an amount of not greater than 3.0% by weight based on total weight of the toner.

When the toner has too small a charge retainability, the number of charge retaining sites of individual toner particles tends to largely differ from each other.

Therefore, the toner preferably has a charge quantity of 15 μC/g, having a negative polarity to a magnetic material.

The magnetic material means a core material for use in the carrier.

When the carrier prevents an overcharged toner having a specific charge retainability, even the toner having a small particle diameter for high-quality images can have quite stable charge quantity.

The toner is preferably included in the developer in an amount of 2 to 12%, and more preferably from 2.5 to 10% by weight.

When less than 2%, an amount of the toner for developing an image is occasionally short. When greater than 12%, the amount of the toner for developing an image is too large to produce a quality halftone image.

Any constituents can be used without a particular limit for a toner included in the electrophotographic developer of the present invention.

Specific examples of the binder resin for use in the toner include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; acrylic ester polymers and copolymers such as polymethylacrylate, polybutylacrylate, polymethylmethacrylate and polybutylmethacrylate; polyvinyl derivatives such as polyvinylchloride and polyvinylacetate; polyester polymers; polyurethane polymers; polyamide polymers; polyimide polymers; polyol polymers; epoxy polymers; terpene polymers; aliphatic or alicycle hydrocarbon resins; aromatic petroleum resins; etc. These can be used a lone or in combination, but the resins are not limited thereto. Among these resins, at least a resin selected from the group consisting of styrene-acrylic copolymer resins, polyester resins and polyol resins is preferably used to impart good electric properties to the resultant toner and decrease production cost thereof. Further, the polyester resins and/or the polyol resins are more preferably used to impart good fixability to the resultant toner.

Known pigments and dyes having been used as colorants for toners can be used as colorants for use in the electrophotographic toner of the present invention. Specific examples of the colorants include carbon black, lamp black, iron black, cobalt blue, nigrosin dyes, aniline blue, phthalocyanine blue, phthalocyanine green, Hansa Yellow G, Rhodamine 6C Lake, chalco oil blue, chrome yellow, quinacridone red, benzidine yellow, rose Bengal, etc. These can be used alone or in combination.

Further, to optionally impart magnetism to toner particles, magnetic components, i.e., iron oxides such as ferrite, magnetite and maghemite; metals such as iron, cobalt and nickel; or their alloyed metals with other metals are included in toner particles alone or in combination. In addition, these components can be used as colorants or with colorants.

The toner included in the electrophotographic developer preferably includes a release agent to perform an oilless fixation without using a fixing oil. Waxes such as polyethylene wax, propylene wax and carnauba wax are preferably used as the release agent included in the toner, but the release agents are not limited thereto. A content of there lease agent is preferably from 0.5 to 10.0%, and more preferably from 3.0 to 8.0% by weight although depending on the release agent and a fixing method for the resultant toner.

Specific examples of the fluidizer include inorganic powders and the hydrophobized inorganic powders such as zinc oxide, tinoxide, aluminiumoxide, titaniumoxide, siliconoxide, strontium titanate, valium titanate, calcium titanate, strontium zirconate, calcium zirconate, lanthanum titanate, calcium carbonate, magnesium carbonate, mica and dolomite. These can be used alone in combination.

As the other additives, fine particles of fluorocarbon resins such as polytetrafluoroethylene, tetrafluoroethylene-hexafluoropropylene copolymers and polyfluorovinylidene may be used as a toner surface improver. These additives are externally added to the toner particles in an amount of from 0.1 to 10 parts by weight per 100 parts by weight of the toner particles although depending on the additives. The additives are optionally mixed in a mixer to adhere or agglutinate on the surface of the tone, or to be free among the toner particles.

Besides, as charge controlling agents improving chargeability of the resultant toner, known charge controlling agents, e.g., positive charge controlling agents such as vinyl copolymers including an amino group, quaternary ammonium salt compounds, nigrosin dyes, polyamine resins, imidazole compounds, azine dyes, triphenylmethane dyes, quanidine compounds and lake pigments; and negative charge controlling agents such as carboxylic acid derivatives, metallic salts of the carboxylic acid, alkoxylate, organic metal complexes and chelate compounds can be used alone or in combination. These can be kneaded and/or added in toner particles. The controlling agents preferably have a dispersed particle diameter not greater than 2.0 μm, and more preferably not greater than 1.0 μm when dispersed in the toner particles to evenly generate an interaction with a surface of a carrier.

The toner particles in the developer of the present invention can be prepared by kneading the materials as mentioned above with known methods using a two-roll, a biaxial extruding kneader, a uniaxial extruding kneader, etc. and pulverizing and classifying the kneaded materials with known mechanical or airstream methods. Dispersants maybe used together to control dispersing status of the colorant and magnetic materials in kneading. Further, the toner particles may include the above-mentioned additives mixed by mixers, etc. to improve surfaces thereof.

The circularity of the toner can typically be controlled by the following method, but not limited thereto.

A toner prepared by a dry pulverization method is thermally or mechanically ensphered, e.g., the toner is thermally ensphered by spraying the toner particles with a thermal current to an atomizer and mechanically ensphered by being mixed with a mixing medium such as glass having a light specific gravity in a ball mill. However, when thermally ensphered, the toner tends to agglutinate, and when mechanically ensphered, a microscopic powder of the toner tends to be generated. Therefore, both need another classification.

In addition, an almost spheric toner prepared by crosslinking and/or elongating toner constituents including a polyester prepolymer having a functional group including a nitrogen atom, polyester, a colorant and a release agent in an aqueous medium in the presence of a particulate resin is preferably used. When the toner prepared by this reaction has a hardened surface, the toner has less hot offset problems such as contamination of a fixer causing contaminated images.

Hereinafter, the toner constituents will be explained.

The polyester can be formed by a polycondensation reaction between a polyol compound and a polycarbonate compound. As the polyol (PO), diol (DIO) and triol (TO) can be used, and the DIO alone or a mixture of the DIO and a small amount of the TO is preferably used. Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polycondensation reaction between the PO and PC is performed by heating the Po and PC at from 150 to 280° C. in the presence of a known esterification catalyst such as tetrabutoxytitanate and dibutyltinoxide and removing produced water while optionally depressurizing to prepare polyester having a hydroxyl group. The polyester preferably has a hydroxyl value not less than 5, and an acid value of from 1 to 30 and more preferably from 5 to 20. When the polyester has an acid value within the range, the resultant toner tends to be negatively charged to have good affinity with a recording paper and low-temperature fixability of the toner on the recording paper improves. However, when the acid value is greater than 30, the resultant toner is not stably charged and the stability becomes worse by environmental variations.

The polyester preferably has a weight-average molecular weight of from 10,000 to 400,000, and more preferably form 20,000 to 200,000. When the weight-average molecular weight is less than 10,000, offset resistance of the resultant toner deteriorates. When greater than 400,000, low-temperature fixability thereof deteriorates.

The polyester preferably includes a urea-modified polyester besides an unmodified polyester formed by the above-mentioned polycondensation reaction. The urea-modified polyester is formed by reacting a polyisocyanate compound (PIC) with a carboxyl group or a hydroxyl group at the end of the polyester formed by the above-mentioned polycondensation reaction to form a polyester prepolymer (A) having an isocyanate group, and reacting amine with the polyester prepolymer (A) to crosslink and/or elongate a molecular chain thereof.

Specific examples of the PIC include aliphatic polyisocyanate such as tetramethylenediisocyanate, hexamethylenediisocyanate and 2,6-diisocyanatemethylcaproate; alicyclicpolyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates.

A content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low-temperature fixability of the toner also deteriorate. In contrast, when the content is greater than 40% by weight, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorondiamine); aliphatic diamines (e.g., ethylene diamine, tetramethylene diamine and hexamethylene diamine); etc. Specific examples of the polyamines (B2) having three or more amino groups include diethylenetriamine, triethylenetetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

The urea-modified polyester may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester can be prepared by a method such as a one-shot method. The PO and PC are heated at from 150 to 280° C. in the presence of a known esterification catalyst such as tetrabutoxytitanate and dibutyltinoxide and removing produced water while optionally depressurizing to prepare polyester having a hydroxyl group. Next, the polyisocyanate is reacted with the polyester at from 40 to 140° C. to form a polyester prepolymer (A) having an isocyanate group. Further, the amines (B) are reacted with the (A) at from 0 to 140° C. to form a urea-modified polyester.

When the PIC, and (A) and (B) are reacted, a solvent may optionally be used. Specific examples of the solvents include inactive solvents with the PIC such as aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The weight-average molecular weight of the urea-modified polyester is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester can be included as a toner binder with the urea-modified polyester. A combination thereof improves low temperature fixability of the resultant toner and glossiness of color images produced thereby, and the combination is more preferably used than using the urea-modified polyester alone. Further, the unmodified polyester may include modified polyester except for the urea-modified polyester.

It is preferable that the urea-modified polyester at least partially mixes with the unmodified polyester to improve the low temperature fixability and hot offset resistance of the resultant toner. Therefore, the urea-modified polyester preferably has a structure similar to that of the unmodified polyester.

A mixing ratio between the unmodified polyester and urea-modified polyester is from 20/80 to 95/5, preferably from 70/30 to 95/5, more preferably from 75/25 to 95/5, and even more preferably from 80/20 to 93/7. When the urea-modified polyester is less than 5%, the hot offset resistance deteriorates, and in addition, it is disadvantageous to have both high temperature preservability and low temperature fixability.

In the present invention, the binder resin including the unmodified polyester and urea-modified polyester preferably has a glass transition temperature (Tg) of from 45 to 65° C., and preferably from 45 to 60° C. When the glass transition temperature is less than 45° C., the high temperature preservability of the toner deteriorates. When higher than 65° C., the low temperature fixability deteriorates.

Further, since the urea-modified polyester is present on a surface of the toner particle, the resultant toner has better heat resistance preservability than known polyester toners even though the glass transition temperature of the urea-modified polyester is low.

The toner of the present invention is produced by the following method, but the method is not limited thereto.

1) A colorant, an unmodified polyester, a polyester prepolymer having an isocyanate group (A) and a release agent are dispersed in an organic solvent to prepare a toner constituent liquid.

The organic solvent is preferably a volatile solvent having a boiling point less than 100° C. because of being easily removed after a toner particle is formed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, methyl ethyl ketone and methyl isobutyl ketone. These can be used alone or in combination. Particularly, aromatic solvents such as the toluene and xylene and halogenated hydrocarbons such as the methylene chloride, 1,2-dichloroethane, chloroform and carbon tetrachloride. A content of the organic solvent is typically from 0 to 300 parts by weight, preferably from 0 to 100 parts by weight, and more preferably from 25 to 70 parts by weight per 100 parts by weight of the polyester prepolymer.

2) The toner constituent liquid is emulsified in an aqueous medium in the presence of a surfactant and a resin particulate material.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

A content of the aqueous medium is typically from 50 to 2,000 parts by weight, and preferably from 100 to 1,000 parts by weight per 100 parts by weight of the toner constituent liquid. When the content is less than 50 parts by weight, the toner constituent liquid is not well dispersed and a toner particle having a predetermined particle diameter cannot be formed. When the content is greater than 2,000 parts by weight, the production cost increases.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, amino alcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium-{omega-fluoroalkanoyl (C6-C8)-N-ethylamino}-1-propane sulfonate, fluoroalkyl (C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl (C6-C10) sulfoneamidepropyltrimethylammonium salts, benzalkonium salts, benzetonium chloride, pyridinium salts, imidazolinium salts, etc. Specific examples of the marketed products thereof include SURFLON S-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

The particulate resin stabilizes a toner particle formed in the aqueous medium. The particulate resin preferably has a coverage of from 10 to90% over the surface of the toner particle. Specific examples thereof include particulate methyl polymethacrylate having particle diameters of 1 and 3 μm, particulate polystyrene having particle diameters of 0.5 and 2 μm and particulate poly(styrene-acrylonitrile) having a particle diameter of 1 μm. Specific examples of the marketed products thereof include PB-200H from Kao Corp., SGP from Soken Co., Ltd., TECHNOPOLYMER-SB from Sekisui Plastics Co., Ltd., SGP-3G from Soken Co., Ltd. and MICROPEARL from Sekisui Chemical Co., Ltd.

In addition, inorganic dispersants such as tricalcium phosphate, calcium carbonate, titanium oxide, colloidal silica and hydroxy apatite can also be used.

As dispersants which can be used in combination with the above-mentioned organic particulate resin and inorganic compounds, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, γ-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm)

means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a toner particle.

The prepared emulsified dispersion (reactant) is gradually heated while stirred in a laminar flow, and an organic solvent is removed from the dispersion after stirred strongly when the dispersion has a specific temperature to from a toner particle having a shape of spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

5) A charge controlling agent is beat in the toner particle, and inorganic fine particles such as silica fine particles and titanium oxide fine particles are externally added thereto to form a toner.

When an external additive and a lubricant are added thereto to prepare a developer, these may be mixed at the same time or separately. Known powder mixers, preferably capable of controlling the inner temperature including a jacket, can be used. Specific examples of the mixers include V-type Mixer, Rocking Mixer, Loedge Mixer, Nauter Mixer and Henschel Mixer. The rotating speed, rolling speed, time and temperature thereof are preferably controlled to prevent burial of the external additive and thin film formation of the lubricant over the surface of the toner.

Thus, a toner having a small particle diameter and a sharp particle diameter distribution can be obtained. Further, the strong agitation in the process of removing the organic solvent can control a shape of the toner from a spheric shape to a spindle shape, and a morphology of the surface thereof from being smooth to being amorphous.

A process cartridge having a frictional charger charging a toner by frictionizing a developer; a rotatable holder holding the developer including the charged toner and a magnetic field generator inside; an image bearer forming an electrostatic latent image; and a developer including atoner, wherein the developer is the developer of the present invention, can be used for long periods and needs to be exchanged less to increase productivity.

The process cartridge further having a toner container including the toner for use in the developer of the present invention, can have along life because the process cartridge can be reused for multiple times only by filling process cartridge with the toner to reduce harmful impacts on the environment.

An image forming apparatus including at least an image bearer bearing a latent image; a charger charging the image bearer while contacting or closing thereto; a latent image former forming a latent image thereon; an image developer developing the latent image with a developer including a toner to form a toner image thereon; and a transferer transferring the toner image onto a recording material sandwiched between the image bearer and a surface transport member transporting while contacting thereto or onto the surface transport member by forming an electric field therebetween, wherein the developer includes the carrier of the present invention and a negatively-charged toner externally having a fluidizer, and having a weight-average particle diameter of from 3 to 10 μm and an average circularity of from 0.93 to 1.00, can produce stable high-quality images for quite long periods.

In addition, the image forming apparatus preferably has a voltage applicator applying a DC bias voltage to the image bearer when producing a halftone image by mainly changing a ratio of a developing area per unit area. In addition, the image developer preferably has a voltage applicator applying a bias voltage, wherein an AC voltage is overlapped with a DC voltage to the developer holder when producing a halftone image by mainly changing an adhesion amount of the toner per unit area.

Further, the image forming apparatus is preferably equipped with a toner recycler including at least a cleaner cleaning the image bearer and a collected toner transporter transporting a toner collected by the cleaner to a developing section of the image developer to save resources.

Hereinafter, the process cartridge and image forming apparatus of the present invention will be explained further in detail, referring to the drawings, but are not limited thereto.

Figure 2:
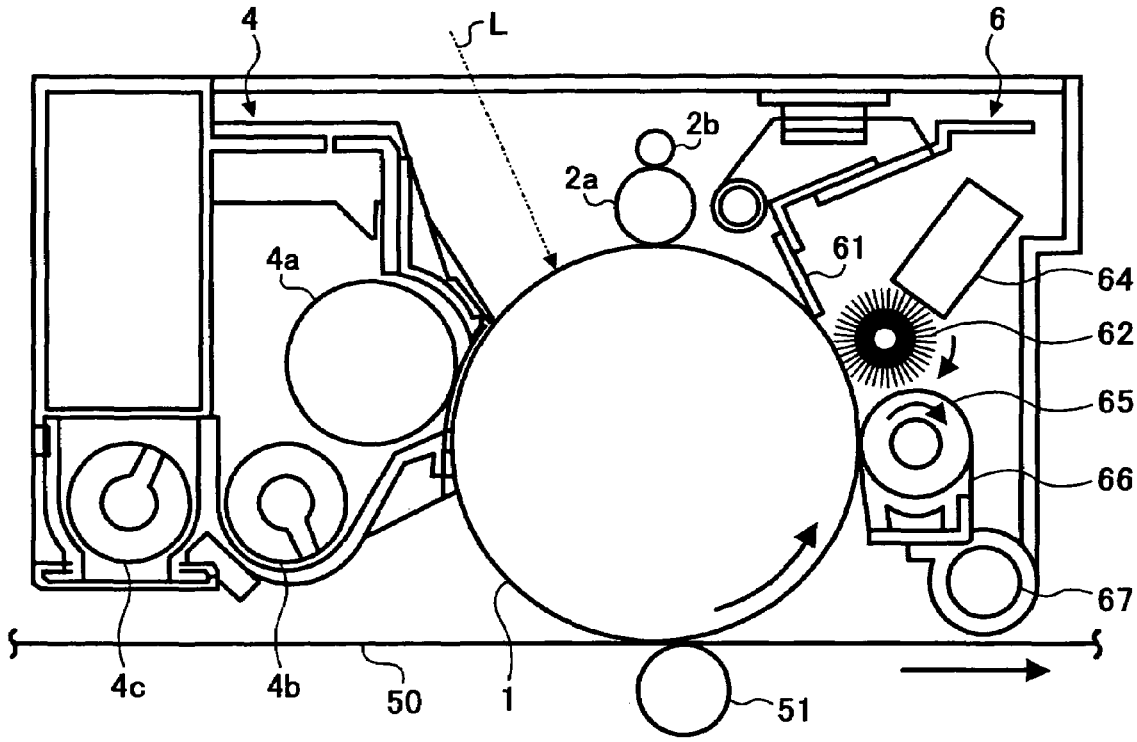
FIG. 2 is a perspective view illustrating an embodiment of the process cartridge of the present invention.
Figure 3A:
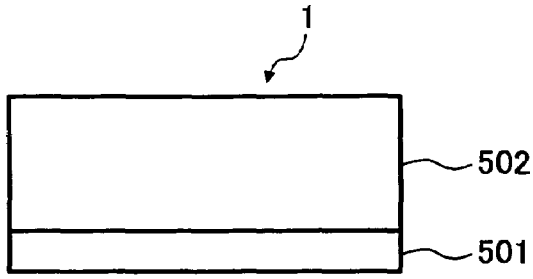
FIGS. 3A to 3D are cross-sectional views illustrating layer constitutions of photoreceptors.
Figure 3B:
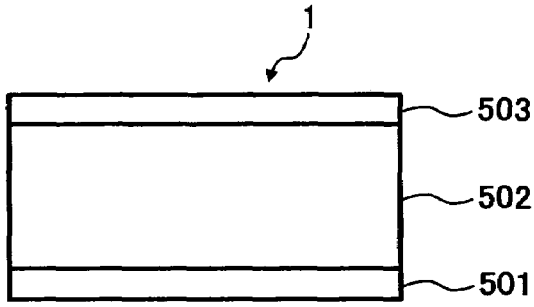
Figure 3C:
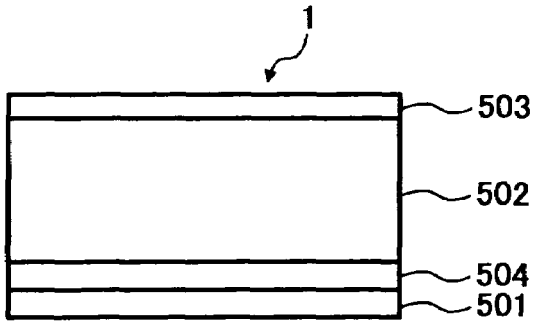
Figure 3D:
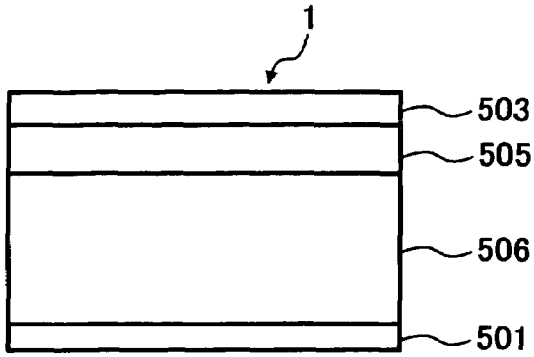

FIG. 2 is a perspective view illustrating an embodiment of the process cartridge of the present invention.

Electroconductive amorphous metals such as amorphous silicon and amorphous selenium or organic compounds such as a bisazo pigment and a phthalocyanine pigment can be used for an image bearer (photoreceptor) 1. The photoreceptor is preferably formed of the organic compound or the amorphous silicon in consideration of environmental problem and disposal after use.

A charger 2 may be a corona charger, a roller charger, a brush charger or a blade charger, and is a roller charger in FIG. 2. The charger 2 includes a charging roller 2*a*, a charging roller cleaner 2*b* cleaning the charging roller 2*a* while contacting thereto and an electric source (not shown) connected thereto. A high voltage is applied to the charging roller 2*a* to generate a corona discharge between the photoreceptor 1 and the charging roller 2*a* and uniformly charge the surface of the photoreceptor 1.

An image developer 4 include a developer bearer 4*a* bearing a developer and providing the developer to the image bearer, and a toner provision room 4*b*. The developer bearer 4*a* is a hollow cylinder rotatably held and includes a magnet roll concentrically fixed, and magnetically absorbs the developer to the circumferential surface thereof and transports the developer. The developer bearer 4*a* is formed of an electroconductive non-magnetic material, and an electric source (not shown) is connected thereto to apply a developing bias thereto. An electric filed is formed on a developing area between the developer bearer 4*a* and the photoreceptor 1 when the developing bias is applied to the developer bearer 4*a*.

As mentioned above, the process cartridge has a long life, and needs to be exchanged less. Plurality thereof in an image forming apparatus further improves operationality and service life thereof.

FIG. 1 is a perspective view illustrating an embodiment of the image forming apparatus of the present invention. This is a full-color image forming apparatus.

An image forming apparatus 100 includes an image former 300, a paper feeder 200, an original reader 400 and an original transporter 500. The image former 300 includes an image forming unit 10, an irradiator 3, a transferer 5 and a fixer 9.

The image forming unit 10 includes 4 units forming a black (K) toner image, a cyan (C) toner image, a magenta (M) toner image and a yellow (Y) toner image respectively. The 4 units include image bearers 1K, 1C, 1M and 1Y in the center thereof respectively, and a charger, an image developer and a cleaner are installed around the respective image bearers.

The irradiator 3 forms an electrostatic latent image on the image bearer 1 based on data read at the original reader 400 or an image signal formed by converting an image signal from outside such as a PC (not shown), scanning a laser beam with a polygon motor and reading the image signal through a mirror.

The transferer 5 includes an intermediate transferer 50 lapping and holding a toner image formed on the image bearer 1, and transfers a color toner image formed on the intermediate transferer 50 onto a recording paper. Otherwise, a recording paper may be transported by a transfer transport belt such that a toner image formed on the respective image bearers 1 is directly transferred onto the recording paper. A first transferer 51 is located acing the image bearer 1 across the intermediate transferer 50. An electric source (not shown) is connected to the first transferer 51, and a voltage is applied thereto to from an electric filed between the image bearer 1 and the intermediate transferer 50 such that a toner image on the image bearer 1 is electrostatically transferred onto the intermediate transferer 50.

Further, the image forming apparatus 100 includes a reversing unit and paper discharge tray.

When an image forming operation starts, the respective image bearers 1 rotate clockwise. The surface thereof is uniformly charged by a charging roller 2*a*. A writing unit 6 irradiates a laser beam according to a yellow image to an image bearer of a process cartridge 10Y, a laser beam according to a magenta image to an image bearer of a process cartridge 10M, a laser beam according to a cyan image to an image bearer of a process cartridge 10C and a laser beam according to a black image to an image bearer of a process cartridge 10K to form a latent image according to the respective color images. The latent images are developed with a magenta, a cyan, a yellow and a black toner when the image bearer 1 rotates to an image developer 4 to form a 4 color toner images. The toner color toner images are lapped on the intermediate transferer 50 to from a full-color image thereon.

On the other hand, a transfer sheet is fed by a separation paper feeder from a paper feed cassette 21 and transported at a fixed speed by a pair of resist rollers located just before the intermediate transferer 50. The full-color image on the intermediate transferer 50 is transferred onto the transfer sheet. The full-color image is fixed thereon by the fixer 9 upon application of heat and pressure. After that, the transfer sheet is discharged onto a discharge tray on the image forming apparatus 1, directly discharged through the reversing unit or is reversed thereby such that another fixed image is formed on the backside of the transfer sheet.

The fixer 9 forms a nip with endless fixing belt suspended by a fixing roller and a heating roller and a pressure roller contacting the fixing belt, and fixes a toner image on the transfer sheet upon application of heat and pressure at the nip. The fixer 9 warms up heating the heating roller with a heating source such as a halogen lamp in the heating roller to heat the fixing belt. When warming up, the fixer heats the fixing belt while transporting the belt increasing closeness between the fixing belt and heating roller such that the fixing belt uniformly has a predetermined temperature. When the fixing belt and pressure roller have the predetermined temperature, a transfer sheet a toner image is formed on is fed by a transfer roller and the toner image is fixed thereon. The toner of the present invention is firmly fixed thereon without peeling even when scraped by hand or with a cloth.

An amorphous silicon photoreceptor (hereinafter referred to as an a-Si photoreceptor) can effectively be used as an image bearer installed in the image forming apparatus of the present invention.

The a-Si photoreceptor is formed by heating an electroconductive substrate at from 50 to 400° C. and forming an a-Si photosensitive layer on the substrate by a vacuum deposition method, a sputtering method, an ion plating method, a heat CVD method, a photo CVD method, a plasma CVD method, etc.

Particularly, the plasma CVD method is preferably used, which forms an a-Si layer on the substrate by decomposing a gas material with a DC, a high-frequency or a microwave glow discharge.

The a-Si photoreceptor has, e.g., the following four types of layer constitutions. FIG. 3 shows schematic views illustrating photosensitive layer compositions of the amorphous photoreceptor for use in the present invention.

An electrophotographic photoreceptor (500) in FIG. 3 (*a*) includes a substrate (501) and a photosensitive layer (503) thereon, which is photoconductive and formed of a-Si.

An electrophotographic photoreceptor (500) in FIG. 3 (*b*) includes a substrate (501), a photosensitive layer (502) thereon and an a-Si surface layer (503) on the photosensitive layer (502).

An electrophotographic photoreceptor (500) in FIG. 3 (*c*) includes a substrate (501), a charge injection prevention layer (504) thereon, a photosensitive layer (502) on the charge injection prevention layer (504) and an a-Si surface layer (503) on the photosensitive layer (502).

An electrophotographic photoreceptor (500) in FIG. 3 (*d*) includes a substrate (501), a photosensitive layer (502) thereon including a charge generation layer (505) and a charge transport layer formed of a-Si, and an a-Si surface layer (503) on the photosensitive layer (502).

The substrate of the photoreceptor may either be electroconductive or insulative. Specific examples of the substrate include metals such as Al, Cr, Mo, Au, In, Nb, Te, V, Ti, Ot, Od and Fe and their alloyed metals such as stainless.

In addition, insulative substrates such as films or sheets of synthetic resins such as polyester, polyethylene, polycarbonate, cellulose acetate, polypropylene, polyvinylchloride, polystyrene, polyamide; glasses; and ceramics can be used, provided at least a surface of the substrate a photosensitive layer is formed on is treated to be electroconductive.

The substrate has the shape of a cylinder, a plate or an endless belt having a smooth or a concave-convex surface. The substrate can have a desired thickness, which can be as thin as possible when an electrophotographic photoreceptor including the substrate is required to have flexibility. However, the thickness is typically not less than 10 μm in terms of production and handling conveniences, and a mechanical strength of the electrophotographic photoreceptor.

The amorphous silicone photoreceptor of the present invention may optionally include the charge injection prevention layer between the electroconductive substrate and the photosensitive layer, which prevents a charge injection from the electroconductive substrate (FIG. 3 (*c*)). Namely, when the photosensitive layer is charged with a charge having a certain polarity, the charge injection prevention layer prevents a charge from being injected into the photosensitive layer from the substrate. However, the charge injection prevention layer does not when the photosensitive layer is charged with a charge having a reverse polarity, i.e., has a dependency on the polarity. The charge injection prevention layer includes more atoms controlling conductivity than the photosensitive layer to have such a capability.

The charge injection prevention layer preferably has a thickness of from 0.1 to 5 μm, more preferably from 0.3 to 4 μm, and most preferably from 0.5 to 3 μm in terms of desired electrophotographic properties and economic effects.

The photosensitive layer (502) is formed on an undercoat layer optionally formed on the substrate 501 and has a thickness as desired, and preferably of from 1 to 100 μm, more preferably from 20 to 50 μm, and most preferably from 23 to 45 μm in terms of desired electrophotographic properties and economic effects.

The charge transport layer is a layer transporting a charge when the photosensitive layer is functionally separated.

The charge transport layer includes at least a silicon atom, a carbon atom and a fluorine atom, and optionally includes a hydrogen atom and an oxygenatom. Further, the charge transport layer has a photosensitivity, a charge retainability, a charge generation capability and a charge transportability as desired. In the present invention, the charge transport layer preferably includes an oxygen atom.

The charge transport layer has a thickness as desired in terms of electrophotographic properties and economic effects, and preferably of from 5 to 50 μm, more preferably from 10 to 40 μm, and most preferably from 20 to 30 μm.

The charge generation layer is a layer generating a charge when the photosensitive layer is functionally separated.

The charge generation layer includes at least a silicon atom, does not include a carbon atom substantially and optionally includes a hydrogen atom. Further, the charge generation layer has a photosensitivity, a charge generation capability and a charge transportability as desired.

The charge transport layer has a thickness as desired in terms of electrophotographic properties and economic effects, and preferably of from 0.5 to 15 μm, more preferably from 1 to 10 μm, and most preferably from 1 to 5 μm.

The amorphous silicone photoreceptor for use in the present invention can optionally includes a surface layer on the photosensitive layer formed on the substrate, which is preferably a a-Si surface layer.

The surface layer has a free surface and is formed to attain objects of the present invention in humidity resistance, repeated use resistance, electric pressure resistance, environment resistance and durability of the photoreceptor.

The surface layer preferably has a thickness of from 0.01 to 3 μm, more preferably from 0. 05 to 2 μm, and most preferably from 0.1 to 1 μm. When less than 0.01 μm, the surface layer is lost due to abrasion while the photoreceptor is used. When greater than 3 μm, deterioration of the electrophotographic properties such as an increase of residual potential of the photoreceptors occurs.

The fixer installed in the image forming apparatus of the present invention includes a heater equipped with a heating element, a film contacting the heater and pressurizer contacting the heater through the film, wherein a recording material an unfixed image is formed on passes through between the film and pressurizer to fix the unfixed image upon application of heat.

A toner having comparatively a small particle diameter is preferably used to produce high-quality images in the present invention. Since a layer thickness of such a toner, i.e., an adherent amount of such a toner in an image can be controlled, a small amount of heat can fix the toner image. Therefore, the following energy-saving fixer using a fixing film is preferably used to reduce electric power consumption.

Figure 4:
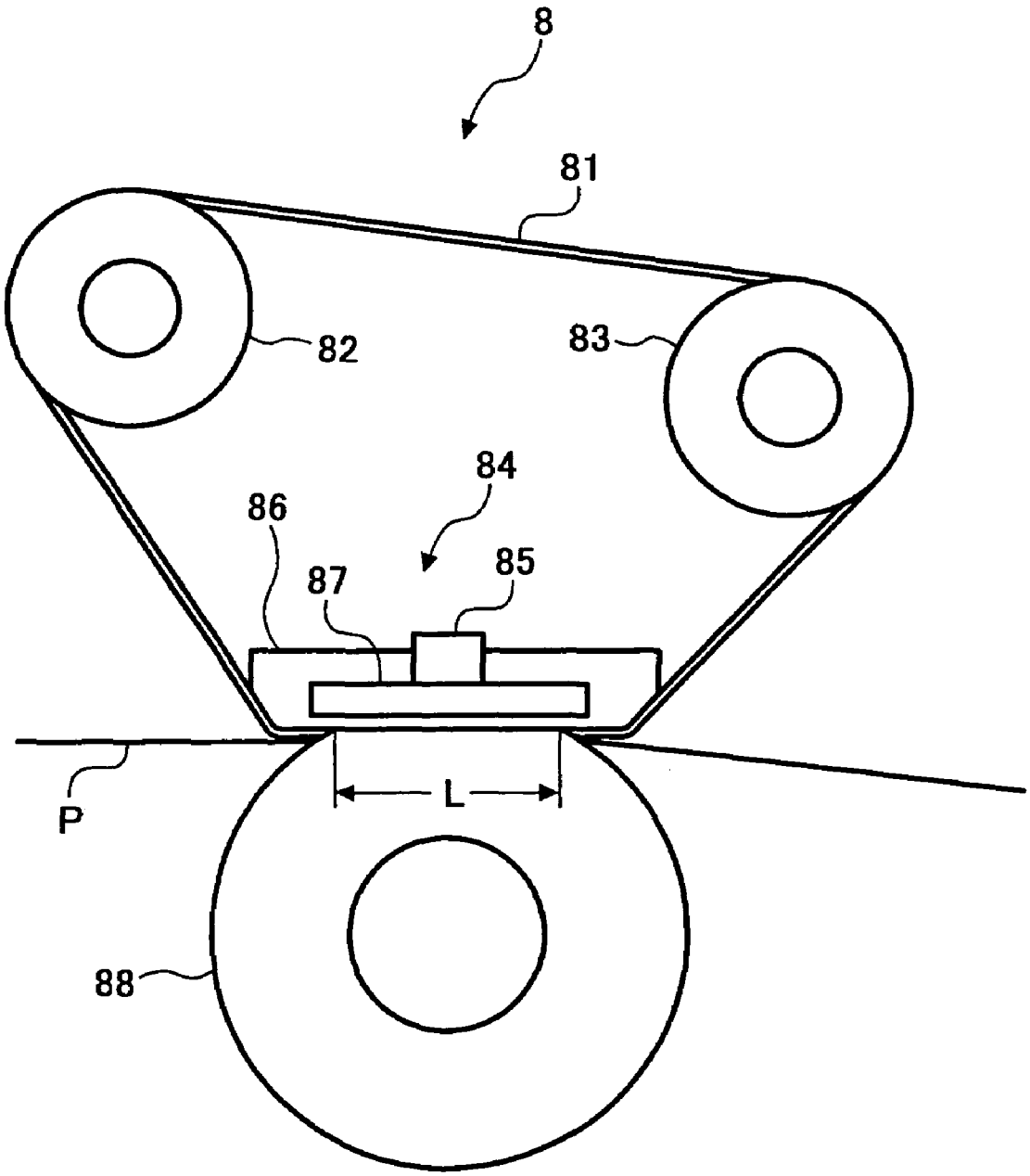
FIG. 4 is a schematic view illustrating a surf fixer using a fixing film.

The fixer is a surf fixer rotating a fixing film as shown in FIG. 4.

The fixing film is a heat resistant film having the shape of an endless belt, which is suspended and strained among a driving roller, a driven roller and a heater located therebetween underneath.

The driven roller is a tension roller as well, and the fixing film rotates clockwise according to a clockwise rotation of the driving roller in FIG. 4. The rotational speed of the fixing film is equivalent to that of a transfer material at a fixing nip area L where a pressure roller and the fixing film contact each other.

The pressure roller has a rubber elastic layer having good releasability such as silicone rubbers, and rotates counterclockwise while contacting the fixing nip area L at a total pressure of from 4 to 10 kg.

The fixing film preferably has a good heat resistance, releasability and durability, and has a total thickness not greater than 100 μm, and preferably not greater than 40 μm. Specific examples of the fixing film include films formed of a single-layered or a multi-layered film of heat resistant resins such as polyimide, polyetherimide, polyethersulfide (PES) and a tetrafluoroethyleneperfluoroalkylvinylethe copolymer resin (PFA) having a thickness of 20 μm, on which (contacting an image) a release layer including a fluorocarbon resin such as a tetrafluoroethylene resin (PTFE) and a PFA and an electroconductive material and having a thickness of 10 μm or an elastic layer formed of a rubber such as a fluorocarbon rubber and a silicone rubber is coated.

In FIG. 4, the heater is formed of a flat substrate and a fixing heater, and the flat substrate is formed of a material having a high heat conductivity and a high resistivity such as alumina. The fixing heater formed of a resistance heater is located on a surface of the heater contacting the fixing film in the longitudinal direction of the heater.

An electric resistant material such as Ag/Pd and $Ta_2N$ is linearly or zonally coated on the fixing heater by a screen printing method, etc.

Both ends of the fixing heater have electrodes (not shown) and the resistant heater generates a heat when electricity passes though the electrodes.

Further, a fixing temperature sensor formed of a thermistor is located on the other side of the substrate opposite to the side on which the fixing heater is located.

Temperature information of the substrate detected by the fixing temperature sensor is transmitted to a controller controlling an electric energy provided to the fixing heater to make the heater have a predetermined temperature.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Core Material Preparation Example 1

Manganese oxide and iron oxide were mixed at a molar ratio (Mn/Fe) of 35/65, and a magnesium hydroxide was added to the mixture so as to have 0.5% by atom based on total atoms of Mn and Fe. After the mixture was pulverized and dispersed by a ball mill in water in a wet pulverizing and dispersing method for 48 hrs, the mixture was dried and pre-fired at 850° C. for 1 hr in a weak reduction atmosphere.

The wet pulverization was performed by filling zirconia balls having a diameter of 10 mm in a ball mill pot by 30% by volume of the ball mill pot capacity and a oxide slurry including a solid content of 25% by 20% by volume thereof.

After crushed, the pre-fired mixture was pulverized and dispersed again by a ball mill in water by a wet pulverizing and dispersing method for 24 hrs to prepare a slurry of manganese and iron complex oxide.

Polyvinylalcohol and a dispersant were added to the slurry as a binder, and the slurry was granulated and dried by a spray drier, and then classified by a supersonic vibration sieve to prepare granulated particles.

The granulated particles were fired at 1,250° C. for 4 hrs in an environmental atmosphere by an electric heating oven to prepare manganese ferrite particles.

Further, the manganese ferrite particles were classified by the supersonic vibration sieve to prepare a magnetic core material having a weight-average particle diameter of 35 μm.

The following materials were dispersed by a homomixer at 40±3° C. for 30 min to prepare a coating liquid for forming a coated layer of a carrier.

(Coated Layer Formulation 1)

| | |
|---|---|
| Acrylic copolymer resin solution having methylacrylate/butylacrylate/2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

After this coating liquid was coated on 5,000 parts of the above-mentioned core material by a fluidized-bed spray coater, the coated core material was heated in an atmosphere having a temperature of 150° C. for 1 hr to prepare a carrier (C1).

A particle diameter distribution of the carrier (C1) was measured by a particle diameter distribution measurer Model X100 from Microtrac Inc. to find that the carrier (C1) had a weight-average particle diameter (D4) of 36.2 μm and a number-average particle diameter (D1) of 34.9 μm.

A cross-sectional surface of the carrier (C1) was observed by a transmission electron microscope at 50,000-fold magnification to measure an average thickness of 10 points of one sample of a coated layer of the carrier (C1) to find that the average thickness was 0.2 μm.

A surface of the carrier (C1) was observed by a scanning electron microscope at 2,000-fold magnification to find that concavities and convexities of alumina were formed, and an average vertical interval of the concavities and convexities on the surfaces of the 20 carriers measured by a laser microscope without contacting the surface was 0.15 μm.

A magnetic brush of the carrier (C1), having a space occupation of 40% was formed between parallel plate electrodes having an area of 2 $cm^2$ and a gap of 0.4 mm, and an AC voltage of 100 V was applied to the magnetic brush at a frequency of 1,000 Hz to measure an electric resistance thereof. The electric resistance thereof was $1.0\times10^{10}$ Ω·cm.

Toner Preparation Example 1

683 parts of water, 11 parts of a sodium salt of an adduct of a sulfuric ester with ethyleneoxide methacrylate (ELEMINOL RS-30 from Sanyo Chemical Industries, Ltd.), 79 parts of styrene, 79 parts of methacrylate, 105 parts of butylacrylate, 13 parts of divinylbenzene and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare a [particulate resin dispersion liquid 1] of a vinyl resin (a copolymer of a sodium salt of an adduct of styrene-methacrylate-butylacrylate-sulfuric ester with ethyleneoxide methacrylate). The [particulate resin dispersion liquid 1] was measured by LA-920 to find a weight-average particle diameter thereof was 0.10 μm. A part of the [particulate resin dispersion liquid 1] was dried to isolate a resin component therefrom. The resin component had a Tg of 95° C., a number-average molecular weight of 140,000 and a weight-average molecular weight of 980,000.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare a [particulate resin dispersion liquid 2] of a vinyl resin (a copolymer of a sodium salt of an adduct of styrene-methacrylate-butylacrylate-sulfuric ester with ethyleneoxide methacrylate). The [particulate resin dispersion liquid 2] was measured by LA-920 to find a volume-average particle diameter thereof was 100 nm. A part of the [particulate resin dispersion liquid 2] was dried to isolate a resin component therefrom. The resin component had a Tg of 80° C., a number-average molecular weight of 1,700 and a weight-average molecular weight of 10,000.

220 parts of an adduct of bisphenol A with 2 moles of ethyleneoxide and 561 parts of an adduct of bisphenol A with 3 moles of propyleneoxide, 218 parts terephthalic acid, 48 parts of an adipic acid and 2 parts of dibutyltinoxide were reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 45 parts of a trimellitic acid anhydride were added therein and the mixture was reacted for 2 hrs at normal pressure and 180° C. to prepare a [low-molecular-weight polyester 1]. The [low-molecular-weight polyester 1] had a number-average molecular weight of 2,500, a weight-average molecular weight of 6,700, a Tg of 43° C. and an acid value of 25.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized to 10 to 15 mm Hg and reacted for 5 hrs to prepare an [intermediate polyester 1]. The intermediate polyester 1 had a number-average molecular weight of 2,100, a weight-average molecular weight of 9,500, a Tg of 55° C. and an acid value of 0.5 and a hydroxyl value of 49.

Next, 410parts of the [intermediate polyester 1], 89parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

170 parts of isophorondiamine and 75 parts of methyl ethyl ketone were reacted at 50° C. for 5 hrs in a reaction vessel including a stirrer and a thermometer to prepare a [ketimine compound 1]. The [ketimine compound 1] had an amine value of 418.

40 parts of carbon black REGAL 400R from Cabot Corp., 60 parts of a binder resin, i.e., a polyester resin RS-801 having an acid value of 10, a Mw of 20,000 and a Tg of 64° C. and 30 parts of water were mixed by a HENSCHEL mixer to prepare a water-logged pigment agglomerate. This was kneaded by a two-roll mil having a surface temperature of 130° C. for 45 min, extended upon application of pressure, cooled and pulverized by a pulverizer from Hosokawa Micron Corporation to prepare a [master batch 1] having a particle diameter of 1 mm. 378 parts of the [low-molecular-weight polyester 1], 100 parts of carnauba wax, 22 parts of charge controlling agent (salicylic acid metal complex E-84 from Orient Chemical Industries, Ltd.) and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [master batch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (UltraViscoMill from IMECS CO., LTD.) for 3 passes under the following conditions:

liquid feeding speed of 1 kg/hr
peripheral disc speed of 6 m/sec, and
filling zirconia beads having diameter 0.5 mm
for 80% by volume.

Next, 1,324 parts of an ethyl acetate solution of the [low-molecular-weight polyester 1] having a concentration of 65% were added to the [material solution 1] and the mixture was stirred by the beads mill for one pass under the same conditions to prepare a [pigment and wax dispersion liquid 1]. The [pigment and wax dispersion liquid 1] had a solid content concentration of 50%.

648 parts of the [pigment and wax dispersion liquid 1], 154 parts of the [prepolymer 1] and 6.6 parts of the [ketimine compound 1] were mixed in a vessel by a TK-type homomixer from Tokushu Kika Kogyo Co., Ltd. at 5,000 rpm for 1 min to prepare an [oil phase mixture 1].

990 parts of water, 8 parts of the [particulate resin dispersion liquid 1], 72 parts of the [particulate resin dispersion liquid 2], 40 parts of an aqueous solution of sodium dodecyldiphenyletherdisulfonate (ELEMINOL MON-7 from Sanyo Chemical Industries, Ltd.) having a concentration of 48.5% and 90 parts of ethylacetate were mixed by a TK-type homomixer from Tokushu Kika Kogyo Co., Ltd. at 3,000 rpm for 1 min in a container, and then 809 parts of the [oil phase mixture 1] were added therein and the mixture was were mixed by a TK-type homomixer at 13,000 rpm for 20 min to prepare a [emulsified slurry 1].

The [emulsified slurry 1] was put in a container including a stirrer and a thermometer, a solvent was removed therefrom at 30° C. for 8 hrs and the slurry was aged at 45° C. for 4 hrs to prepare a [dispersion slurry 1].

After the [dispersion slurry 1] was filtered under reduced pressure to prepare a filtered cake, 300 parts of ion-exchange water were added to the filtered cake and mixed by the TK-type homomixer at 12,000 rpm for 10 min, which was performed 3 times to prepare a [filtered cake 1].

The [filtered cake 1] was dried by an air drier at 45° C. for 48 hrs and sieved by a mesh having an opening of 75 μm to prepare a [toner particle 1] having a particulate-resin residual ratio of 3.8%.

A hydrophobized (with hexamethyldisilazane) silica having an average particle diameter of 12 nm was added to the [toner particle 1] so as to have an amount of 2.0% by weight, and the mixture was mixed by a HENSCHEL MIXER from Mitsui Mining Co., Ltd. for 2 min to prepare a toner (T1).

A particle diameter distribution of the toner (T1) was measured by FPIA-2100 from SYSMEX CORPORATION to find that the toner (T1) has a weight-average particle diameter of 5.30 μm, a number-average particle diameter of 4.65 μm, a 10% cumulative particle diameter based on number standard of 2.2 μm and a circularity of 0.97.

The toner (T1) and carrier (C1) had a frictional charge quantity of −20 μC/g. The toner and carrier were frictionized each other by a shaker for 10 min with a toner concentration of 8% by weight. The charge quantity was measured by a blowoff apparatus from Toshiba Corp.

Next, 920 parts of the carrier (C1) and 80 parts of the toner (T1) were mixed by a tubular mixer for 1 min to prepare a two-component developer.

300,000 copies of an A4 original having an image area ratio of 6% were continuously produced by a color printer IPSio color 8000® from Ricoh Company, Ltd. with the two-component developer. Image qualities of the initial image and the image after 300,000 copies were produced of a letter image, a halftone image and a solid image were evaluated.

Then, the developing pole had a magnetic flux density of 110 mT and a minimum distance between the developing sleeve and the photoreceptor in the developing section was 0.6 mm.

An electrostatic latent image on the image bearer had a potential of −700 V at the background and −200 V at the image area when the image was produced. A developing bias in which a DC voltage of −500 V was overlapped with an AC voltage having a voltage between the peaks of 1,500 V and a frequency of 2,000 Hz was applied to the developing sleeve.

Whether the letter image was fattened, the half tone image had a surface roughness and each image had other defects, and gradient of the halftone image and stability of the image density of the solid image were evaluated.

Both the initial images and images after 300,000 copies had good image qualities, and therefore the carrier of the present invention can effectively be used for the image quality and life. The image density was measured by Macbeth densitometer RD-914 and the other items were visually evaluated.

The evaluation results of each initial image and image after 300,000 copies were produced are shown in Tables 1, 2 and 3.

Example 2

The procedures for preparation and evaluation of the carrier (C1) in Example 1 were repeated to prepare and evaluate a carrier (C2) except for using a coating liquid having the following formulation.

(Coated Layer Formulation 2)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin Having dimethylmethoxysilane/ methyltriethoxysilane of 85/15 mol % and a solid content of 20% | 150 |
| Titanium tetraisopropoxide | 9 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 3

The procedures for preparation and evaluation of the carrier (C1) in Example 1 were repeated to prepare and evaluate a carrier (C3) except for using a coating liquid having the following formulation.

(Coated Layer Formulation 3)

| | |
|---|---|
| Acrylic copolymer resin solution having methylacrylate/butylacrylate/ 2hydroxyethylacrylate/2hydroxymethylacrylate of 60/35/5/2 mol % and a solid content of 50% by weight | 80 |

-continued

| | |
|---|---|
| Straight silicone resin having dimethylmethoxysilane/methyltriethoxysilane of 85/15 mol % and a solid content of 20% | 150 |
| Aluminum triisopropoxide | 6 |
| Titania particles having a number-average particle diameter of 0.25 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 4

The procedures for preparation and evaluation of the carrier (C1) in Example 1 were repeated to prepare and evaluate a carrier (C4) except for using a coating liquid having the following formulation.

(Coated Layer Formulation 4)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Silica particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 5

The procedures for preparation and evaluation of the carrier (C1) in Example 1 were repeated to prepare and evaluate a carrier (C5) except for using a coating liquid having the following formulation.

(Coated Layer Formulation 5)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Alumina particles having a number-average particle diameter of 0.3 um | 100 |
| Carbon black | 4 |
| Coupling agent (titanium-γ-(2aminoethyl)aminopropyltrimethoxysilane) | 2 |
| Toluene | 750 |
| Isopropanol | 750 |

The evaluation results are shown in Tables 1, 2 and 3.

Example 6

The procedures for preparation and evaluation of the carrier (C1) in Example 1 were repeated to prepare and evaluate a carrier (C6) except for using a coating liquid having the following formulation.

(Coated Layer Formulation 6)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Alumina particles having a number-average particle diameter of 0.3 μm | 100 |
| Carbon black | 4 |
| Toluene | 750 |
| Isopropanol | 750 |

The evaluation results are shown in Tables 1, 2 and 3.

Example 7

The procedures for preparation and evaluation of the carrier (C1) in Example 1 were repeated to prepare and evaluate a carrier (C7) except for using a coating liquid having the following formulation.

(Coated Layer Formulation 7)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Alumina particles having a number-average particle diameter of 0.3 μm | 100 |
| Carbon black | 7 |
| Coupling agent (γ-(2aminoethyl)aminopropyltrimethoxysilane) | 2 |
| Toluene | 750 |
| Isopropanol | 750 |

The evaluation results are shown in Tables 1, 2 and 3.

Example 8

The procedures for preparation and evaluation of the carrier (C1) in Example 1 were repeated to prepare and evaluate a carrier (C8) except for using a coating liquid having the following formulation.

(Coated Layer Formulation 8)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |

-continued

| | |
|---|---|
| Aluminum triisopropoxide | 6 |
| Alumina particles having a number-average particle diameter of 0.3 μm | 100 |
| Carbon black | 2 |
| Coupling agent (γ-(2aminoethyl)aminopropyltrimethoxysilane) | 1 |
| Toluene | 750 |
| Isopropanol | 750 |

Example 9

The procedures for preparation and evaluation of the carrier (C1) in Example 1 were repeated to prepare and evaluate a carrier (C9) except for using a coating liquid having the following formulation.

(Coated Layer Formulation 9)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Alumina particles having a number-average particle diameter of 0.3 μm | 100 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 10

The procedures for preparation and evaluation of the carrier (C1) in Example 1 were repeated to prepare and evaluate a carrier (C10) except for using a coating liquid having the following formulation.

(Coated Layer Formulation 10)

| | |
|---|---|
| Acrylic copolymer resin solution having methylacrylate/butylacrylate/ 2hydroxyethylacrylate of 60/35/5 mol % and a solid content of 50% by weight | 240 |
| Straight silicone resin having dimethylmethoxysilane/methyltriethoxysilane of 85/15 mol % and a solid content of 20% | 450 |
| Aluminum triisopropoxide | 18 |
| Alumina particles having a number-average particle diameter of 0.3 μm | 100 |
| Carbon black | 12 |
| Coupling agent (γ-(2aminoethyl)aminopropyltrimethoxysilane) | 3 |
| Toluene | 500 |
| Isopropanol | 700 |

The evaluation results are shown in Tables 1, 2 and 3.

Example 11

The procedures for preparation and evaluation of the carrier (C1) in Example 1 were repeated to prepare and evaluate a carrier (C11) except for using a coating liquid having the following formulation.

(Coated Layer Formulation 11)

| | |
|---|---|
| Acrylic copolymer resin solution having methylacrylate/butylacrylate/ 2hydroxyethylacrylate of 60/35/5 mol % and a solid content of 50% by weight | 12 |
| Straight silicone resin having dimethylmethoxysilane/methyltriethoxysilane of 85/15 mol % and a solid content of 20% | 23 |
| Aluminum triisopropoxide | 1 |
| Alumina particles having a number-average particle diameter of 0.3 μm | 60 |
| Carbon black | 1 |
| Coupling agent (γ-(2aminoethyl)aminopropyltrimethoxysilane) | 1 |
| Toluene | 500 |
| Isopropanol | 500 |

The evaluation results are shown in Tables 1, 2 and 3.

Example 12

The procedures for preparation and evaluation of the carrier (C1) in Example 1 were repeated to prepare and evaluate a carrier (C12) except for using a coating liquid having the following formulation.

(Coated Layer Formulation 12)

| | |
|---|---|
| Acrylic copolymer resin solution having methylacrylate/butylacrylate/ 2hydroxyethylacrylate of 60/35/5 mol % and a solid content of 50% by weight | 280 |
| Straight silicone resin having dimethylmethoxysilane/methyltriethoxysilane of 85/15 mol % and a solid content of 20% | 500 |
| Aluminum triisopropoxide | 21 |
| Alumina particles having a number-average particle diameter of 0.4 μm | 100 |
| Carbon black | 4 |
| Coupling agent (γ-(2aminoethyl)aminopropyltrimethoxysilane) | 3 |
| Toluene | 500 |
| Isopropanol | 750 |

The evaluation results are shown in Tables 1, 2 and 3.

Example 13

The procedures for preparation and evaluation of the carrier (C1) in Example 1 were repeated to prepare and evaluate a carrier (C13) except for using a coating liquid having the following formulation.

(Coated Layer Formulation 13)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Silica particles having a number-average particle diameter of 0.1 μm | 100 |

-continued

| | |
|---|---|
| Carbon black | 4 |
| Coupling agent (γ-(2aminoethyl)aminopropyltrimethoxysilane) | 1 |
| Toluene | 750 |
| Isopropanol | 1,000 |

The evaluation results are shown in Tables 1, 2 and 3.

Example 14

The procedures for preparation and evaluation of the carrier (C1) in Example 1 were repeated to prepare and evaluate a carrier (C14) except for using a coating liquid having the following formulation.

(Coated Layer Formulation 14)

| | |
|---|---|
| Acrylic copolymer resin solution having methylacrylate/butylacrylate/ 2hydroxyethylacrylate of 60/35/5 mol % and a solid content of 50% by weight | 720 |
| Straight silicone resin having dimethylmethoxysilane/methyltriethoxysilane of 85/15 mol % and a solid content of 20% | 1,350 |
| Aluminum triisopropoxide | 54 |
| Alumina particles having a number-average particle diameter of 2.5 μm | 100 |
| Carbon black | 18 |
| Coupling agent γ-(2aminoethyl)aminopropyltrimethoxysilane) | 5 |
| Isopropanol | 750 |

The evaluation results are shown in Tables 1, 2 and 3.

Example 15

The procedures for preparation and evaluation of the carrier (C1) in Example 1 were repeated to prepare and evaluate a carrier (C15) except for using a coating liquid having the following formulation.

(Coated Layer Formulation 15)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/ methyltriethoxysilane of 85/15 mol % and a solid content of 20% | 150 |
| Aluminum triisopropoxide | 6 |
| Calcium carbonate particles having a number-average particle diameter of 0.25 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 16

The procedures for preparation and evaluation of the carrier (C1) in Example 1 were repeated to prepare and evaluate a carrier (C16) except for using a coating liquid having the following formulation.

(Coated Layer Formulation 16)

| | |
|---|---|
| Acrylic copolymer resin solution having methylacrylate/butylacrylate/ 2hydroxyethylacrylate of 60/35/5 mol % and a solid content of 50% by weight | 80 |
| Acrylic-modified silicone resin having methylmethacrylate/ methyl silicone of 30/70% by weight and a solid content of 20% | 150 |
| Aluminum triisopropoxide | 6 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 17

The procedures for preparation and evaluation of the carrier (C1) in Example 1 were repeated to prepare and evaluate a carrier (C17) except for using a coating liquid having the following formulation.

(Coated Layer Formulation 17)

| | |
|---|---|
| Acrylic copolymer resin solution having methylacrylate/butylacrylate/ 2hydroxyethylacrylate of 60/35/5 mol % and a solid content of 50% by weight | 140 |
| Aluminum triisopropoxide | 12 |
| Alumina particles having a number-average particle diameter of 0.3 μm | 100 |
| Carbon black | 4 |
| Coupling agent (γ-(2aminoethyl)aminopropyltrimethoxysilane) | 2 |
| Toluene | 750 |
| Isopropanol | 750 |

The evaluation results are shown in Tables 1, 2 and 3.

Example 18

The procedures for preparation and evaluation of the carrier (C1) in Example 1 were repeated to prepare and evaluate a carrier (C18) except for using a coating liquid having the following formulation.

(Coated Layer Formulation 18)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/ methyltriethoxysilane of 85/15 mol % and a solid content of 20% | 150 |
| Aluminum triisopropoxide | 3 |
| Alumina particles having a number-average particle diameter of 0.3 μm | 100 |
| Carbon black | 4 |

-continued

| | |
|---|---|
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Example 19

The procedures for preparation and evaluation of the carrier (C1) in Example 1 were repeated to prepare and evaluate a carrier (C19) except for using a coating liquid having the following formulation.

(Coated Layer Formulation 19)

| | |
|---|---|
| Acrylic copolymer resin solution having methylacrylate/butylacrylate/ vinylalcohol of 55/42/3 mol % and a solid content of 50% by weight | 80 |
| Straight silicone resin having dimethylmethoxysilane/ methyltriethoxysilane of 85/15 mol % and a solid content of 20% | 150 |
| Aluminum triisopropoxide | 6 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 400 |
| Isopropanol | 600 |
| Ethanol | 500 |

The evaluation results are shown in Tables 1, 2 and 3.

Example 20

The procedures for preparation and evaluation of the carrier (C1) in Example 1 were repeated to prepare and evaluate a carrier (C20) except for using a coating liquid having the following formulation.

(Coated Layer Formulation 20)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/ methyltriethoxysilane of 85/15 mol % and a solid content of 20% | 150 |
| Zirconium tetraisopropoxide | 9 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Comparative Example 1

The procedures for preparation and evaluation of the carrier (C1) in Example 1 were repeated to prepare and evaluate a carrier (C21) except for using a coating liquid having the following formulation.

(Coated Layer Formulation 21)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/ methyltriethoxysilane of 85/15 mol % and a solid content of 20% | 150 |
| Aluminum triisopropoxide | 6 |
| Carbon black | 4 |
| Coupling agent (γ-(2aminoethyl)aminopropyltrimethoxysilane | 1 |
| Toluene | 750 |
| Isopropanol | 750 |

The evaluation results are shown in Tables 1, 2 and 3.

Comparative Example 2

The procedures for preparation and evaluation of the carrier (C1) in Example 1 were repeated to prepare and evaluate a carrier (C22) except for using a coating liquid having the following formulation.

(Coated Layer Formulation 22)

| | |
|---|---|
| Acrylic copolymer resin solution having methylacrylate/butylacrylate of 60/40 mol % and a solid content of 50% by weight | 80 |
| Straight silicone resin having dimethylmethoxysilane/methyltriethoxysilane of 85/15 mol % and a solid content of 20% | 150 |
| Aluminum triisopropoxide | 6 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Comparative Example 3

The procedures for preparation and evaluation of the carrier (C1) in Example 1 were repeated to prepare and evaluate a carrier (C23) except for using a coating liquid having the following formulation.

(Coated Layer Formulation 23)

| | |
|---|---|
| Acrylic copolymer resin solution having methylacrylate/butylacrylate/ 2hydroxyethylacrylate of 60/35/5 mol % and a solid content of 50% by weight | 80 |
| Straight silicone resin having dimethylmethoxysilane/methyltriethoxysilane of 85/15 mol % and a solid content of 20% | 150 |
| Alumina particles having a number-average particle diameter of 0.3 μm | 100 |
| Carbon black | 4 |
| Coupling agent (γ-(2aminoethyl)aminopropyltrimethoxysilane) | 1 |

-continued

| | |
|---|---|
| Toluene | 750 |
| Isopropanol | 750 |

The evaluation results are shown in Tables 1, 2 and 3.

Comparative Example 4

The procedures for preparation and evaluation of the carrier (C1) in Example 1 were repeated to prepare and evaluate a carrier (C24) except for using a coating liquid having the following formulation.

(Coated Layer Formulation 24)

| | |
|---|---|
| Acrylic copolymer resin solution having methylacrylate/butylacrylate of 60/40 mol % and a solid content of 50% by weight | 80 |
| Straight silicone resin having dimethylmethoxysilane/ methyltriethoxysilane of 85/15 mol % and a solid content of 20% | 150 |
| Alumina particles having a number-average particle diameter of 0.3 μm | 100 |
| Carbon black | 4 |
| Coupling agent (γ-(2aminoethyl)aminopropyltrimethoxysilane) | 1 |
| Toluene | 750 |
| Isopropanol | 750 |

The evaluation results are shown in Tables 1, 2 and 3.

Examples 21 and 22

The procedures for preparation and evaluation of the carrier (C1) in Example 1 were repeated to prepare and evaluate the carrier (C1) except for changing a ratio (C1/T1) of the carrier (C1) to the toner (T1) into 985/15 and 870/130 respectively.

The evaluation results are shown in Tables 1, 2 and 3.

Example 23

The procedure for preparation of the toner (T1) in Example 1 was repeated to prepare a toner (T2) except for changing the fluidizer from 2.0% by weight of the hydrophobized (with hexamethyldisilazane) silica having an average particle diameter of 12 nm to each 1.0% by weight of the hydrophobized (with hexamethyldisilazane) silica and hydrophobized titania having an average particle diameter of 10 nm.

The procedures for preparation and evaluation of the carrier (C1) in Example 1 were repeated to prepare and evaluate the carrier (C1) except for changing the toner (T1) to the toner (T2).

The evaluation results are shown in Tables 1, 2 and 3.

Example 24

The procedure for preparation of the toner (T1) in Example 1 was repeated to prepare a toner (T3) except for changing an amount of the silica from 2.0% by weight to 0.4% by weight.

The procedures for preparation and evaluation of the carrier (C1) in Example 1 were repeated to prepare and evaluate the carrier (C1) except for changing the toner (T1) to the toner (T3).

The evaluation results are shown in Tables 1, 2 and 3.

Example 25

The procedure for preparation of the toner (T1) in Example 1 was repeated to prepare a toner (T4) except for changing an amount of the silica from 2.0% by weight to 3.5% by weight.

The procedures for preparation and evaluation of the carrier (C1) in Example 1 were repeated to prepare and evaluate the carrier (C1) except for changing the toner (T1) to the toner (T4).

The evaluation results are shown in Tables 1, 2 and 3.

Example 26

The procedure for preparation of the toner (T1) in Example 1 was repeated to prepare a toner (T5) having a different circularity except for pre-aging the [emulsified slurry 1] for 5 hrs before removing the solvent.

The procedures for preparation and evaluation of the carrier (C1) in Example 1 were repeated to prepare and evaluate the carrier (C1) except for changing the toner (T1) to the toner (T5).

The evaluation results are shown in Tables 1, 2 and 3.

Example 27

The procedure for preparation of the toner (T1) in Example 1 was repeated to prepare a toner (T6) having a smaller particle diameter than the toner (T1) except for controlling the conditions of emulsifying the [oil phase mixture 1] and adding 1.0% by weight of the hydrophobized titania having an average particle diameter of 10 nm as the fluidizer.

The procedures for preparation and evaluation of the carrier (C1) in Example 1 were repeated to prepare and evaluate the carrier (C1) except for changing the toner (T1) to the toner (T6).

The evaluation results are shown in Tables 1, 2 and 3.

Example 28

The procedure for preparation of the toner (T1) in Example 1 was repeated to prepare a toner (T7) having a larger particle diameter than the toner (T1) except for controlling the conditions of emulsifying the [oil phase mixture 1] and changing an amount of the silica from 2.0% by weight to 1.0% by weight.

The procedures for preparation and evaluation of the carrier (C1) in Example 1 were repeated to prepare and evaluate the carrier (C1) except for changing the toner (T1) to the toner (T7).

The evaluation results are shown.in Tables 1, 2 and 3.

The properties of the carriers and toners of Example 1 to 28 and Comparative Examples 1 to 4 are shown in Table 1.

TABLE 1

| | | | Carrier | | | | | |
|---|---|---|---|---|---|---|---|---|
| | Carrier | Toner | Alkoxide/ Resin Hydroxyl group | Particle Diameter of Particulate Inorganic Material D (μm) | Vertical Interval of concavity and convexity (μm) | Layer Thickness h (μm) | D/h | Electric resistance (Ω · cm) |
| Ex. 1 | C1 | T1 | 1.52 | 0.3 | 0.15 | 0.20 | 1.5 | $1.0 \times 10^{10}$ |
| Ex. 2 | C2 | T1 | 1.65 | 0.3 | 0.15 | 0.20 | 1.5 | $9.5 \times 10^{9}$ |
| Ex. 3 | C3 | T1 | 1.52 | 0.25 | 0.1 | 0.20 | 1.3 | $9.0 \times 10^{9}$ |
| Ex. 4 | C4 | T1 | 1.52 | 0.3 | 0.15 | 0.20 | 1.5 | $1.2 \times 10^{10}$ |
| Ex. 5 | C5 | T1 | 1.52 | 0.3 | 0.15 | 0.20 | 1.5 | $1.1 \times 10^{10}$ |
| Ex. 6 | C6 | T1 | 1.52 | 0.3 | 0.15 | 0.20 | 1.5 | $8.2 \times 10^{9}$ |
| Ex. 7 | C7 | T1 | 1.52 | 0.3 | 0.15 | 0.20 | 1.5 | $7.8 \times 10^{8}$ |
| Ex. 8 | C8 | T1 | 1.52 | 0.3 | 0.15 | 0.20 | 1.5 | $2.0 \times 10^{11}$ |
| Ex. 9 | C9 | T1 | 1.52 | 0.3 | 0.15 | 0.20 | 1.5 | $6.8 \times 10^{11}$ |
| Ex. 10 | C10 | T1 | 1.56 | 0.3 | 0.08 | 0.60 | 0.5 | $6.7 \times 10^{10}$ |
| Ex. 11 | C11 | T1 | 1.67 | 0.3 | 0.2 | 0.03 | 10.0 | $5.5 \times 10^{9}$ |
| Ex. 12 | C12 | T1 | 1.56 | 0.4 | 0.08 | 0.70 | 0.6 | $7.1 \times 10^{10}$ |
| Ex. 13 | C13 | T1 | 1.52 | 0.1 | 0.1 | 0.20 | 0.5 | $4.1 \times 10^{9}$ |
| Ex. 14 | C14 | T1 | 1.66 | 2.5 | 0.6 | 1.80 | 1.4 | $8.3 \times 10^{10}$ |
| Ex. 15 | C15 | T1 | 1.52 | 0.25 | 0.1 | 0.20 | 1.3 | $2.5 \times 10^{10}$ |
| Ex. 16 | C16 | T1 | 1.52 | 0.3 | 0.15 | 0.20 | 1.5 | $7.4 \times 10^{9}$ |
| Ex. 17 | C17 | T1 | 1.75 | 0.3 | 0.2 | 0.15 | 2.0 | $7.0 \times 10^{9}$ |
| Ex. 18 | C18 | T1 | 0.76 | 0.3 | 0.15 | 0.20 | 1.5 | $4.3 \times 10^{9}$ |
| Ex. 19 | C19 | T1 | 2.54 | 0.3 | 0.15 | 0.20 | 1.5 | $2.5 \times 10^{9}$ |
| Ex. 20 | C20 | T1 | 1.42 | 0.3 | 0.15 | 0.20 | 1.5 | $1.6 \times 10^{10}$ |
| Ex. 21 | C1 | T1 | 1.52 | 0.3 | 0.15 | 0.20 | 1.5 | $1.0 \times 10^{10}$ |
| Ex. 22 | C1 | T1 | 1.52 | 0.3 | 0.15 | 0.20 | 1.5 | $1.0 \times 10^{10}$ |
| Ex. 23 | C1 | T2 | 1.52 | 0.3 | 0.15 | 0.20 | 1.5 | $1.0 \times 10^{10}$ |
| Ex. 24 | C1 | T3 | 1.52 | 0.3 | 0.15 | 0.20 | 1.5 | $1.0 \times 10^{10}$ |
| Ex. 25 | C1 | T4 | 1.52 | 0.3 | 0.15 | 0.20 | 1.5 | $1.0 \times 10^{10}$ |
| Ex. 26 | C1 | T5 | 1.52 | 0.3 | 0.15 | 0.20 | 1.5 | $1.0 \times 10^{10}$ |
| Ex. 27 | C1 | T6 | 1.52 | 0.3 | 0.15 | 0.20 | 1.5 | $1.0 \times 10^{10}$ |
| Ex. 28 | C1 | T7 | 1.52 | 0.3 | 0.15 | 0.20 | 1.5 | $1.0 \times 10^{10}$ |
| Com. Ex. 1 | C21 | T1 | 1.52 | — | — | 0.20 | — | $5.1 \times 10^{9}$ |
| Com. Ex. 2 | C22 | T1 | — | 0.3 | 0.15 | 0.20 | 1.5 | $8.5 \times 10^{9}$ |
| Com. Ex. 3 | C23 | T1 | 0 | 0.3 | 0.15 | 0.20 | 1.5 | $6.3 \times 10^{9}$ |
| Com. Ex. 4 | C24 | T1 | — | 0.3 | 0.15 | 0.20 | 1.5 | $9.1 \times 10^{9}$ |

TABLE 1-continued

| | Carrier | Toner | Toner: Weight-Average Particle Diameter (μm) | Toner: Circularity | Toner: Amount of Fluidizer (Wt. %) | Toner: Charge Quantity with Magnetic Material (μc/g) |
|---|---|---|---|---|---|---|
| Ex. 1 | C1 | T1 | 5.0 | 0.97 | 2.00 | 20 |
| Ex. 2 | C2 | T1 | 5.0 | 0.97 | 2.00 | 20 |
| Ex. 3 | C3 | T1 | 5.0 | 0.97 | 2.00 | 20 |
| Ex. 4 | C4 | T1 | 5.0 | 0.97 | 2.00 | 20 |
| Ex. 5 | C5 | T1 | 5.0 | 0.97 | 2.00 | 20 |
| Ex. 6 | C6 | T1 | 5.0 | 0.97 | 2.00 | 20 |
| Ex. 7 | C7 | T1 | 5.0 | 0.97 | 2.00 | 20 |
| Ex. 8 | C8 | T1 | 5.0 | 0.97 | 2.00 | 20 |
| Ex. 9 | C9 | T1 | 5.0 | 0.97 | 2.00 | 20 |
| Ex. 10 | C10 | T1 | 5.0 | 0.97 | 2.00 | 20 |
| Ex. 11 | C11 | T1 | 5.0 | 0.97 | 2.00 | 20 |
| Ex. 12 | C12 | T1 | 5.0 | 0.97 | 2.00 | 20 |
| Ex. 13 | C13 | T1 | 5.0 | 0.97 | 2.00 | 20 |
| Ex. 14 | C14 | T1 | 5.0 | 0.97 | 2.00 | 20 |
| Ex. 15 | C15 | T1 | 5.0 | 0.97 | 2.00 | 20 |
| Ex. 16 | C16 | T1 | 5.0 | 0.97 | 2.00 | 20 |
| Ex. 17 | C17 | T1 | 5.0 | 0.97 | 2.00 | 20 |
| Ex. 18 | C18 | T1 | 5.0 | 0.97 | 2.00 | 20 |
| Ex. 19 | C19 | T1 | 5.0 | 0.97 | 2.00 | 20 |
| Ex. 20 | C20 | T1 | 5.0 | 0.97 | 2.00 | 20 |
| Ex. 21 | C1 | T1 | 5.0 | 0.97 | 2.00 | 20 |
| Ex. 22 | C1 | T1 | 5.0 | 0.97 | 2.00 | 20 |
| Ex. 23 | C1 | T2 | 5.0 | 0.97 | 2.00 | 12 |
| Ex. 24 | C1 | T3 | 5.0 | 0.97 | 0.40 | 16 |
| Ex. 25 | C1 | T4 | 3.2 | 0.97 | 3.50 | 27 |
| Ex. 26 | C1 | T5 | 7.0 | 0.92 | 2.00 | 18 |
| Ex. 27 | C1 | T6 | 2.5 | 0.98 | 3.00 | 22 |
| Ex. 28 | C1 | T7 | 11.0 | 0.94 | 1.00 | 15 |
| Com. Ex. 1 | C21 | T1 | 5.0 | 0.97 | 2.00 | 20 |
| Com. Ex. 2 | C22 | T1 | 5.0 | 0.97 | 2.00 | 20 |
| Com. Ex. 3 | C23 | T1 | 5.0 | 0.97 | 2.00 | 20 |
| Com. Ex. 4 | C24 | T1 | 5.0 | 0.97 | 2.00 | 20 |

The evaluation results of the initial images are shown in Table 2.

⊙ represents excellent, ○ represents no problem in practical use, Δ represents acceptable and X represents unusable.

TABLE 2

| | Letter Fattening | Surface Roughness of Halftone Image | Halftone Image | Image Density | Others |
|---|---|---|---|---|---|
| Ex. 1 | ⊙ | ⊙ | ⊙ | 1.41 | |
| Ex. 2 | ⊙ | ⊙ | ⊙ | 1.43 | |
| Ex. 3 | ⊙ | ⊙ | ⊙ | 1.41 | |
| Ex. 4 | ⊙ | ⊙ | ⊙ | 1.40 | |
| Ex. 5 | ⊙ | ⊙ | ⊙ | 1.25 | |
| Ex. 6 | ⊙ | ⊙ | ○ | 1.41 | |
| Ex. 7 | ○ | ○ | ⊙ | 1.44 | |
| Ex. 8 | ⊙ | ⊙ | ○ | 1.39 | |
| Ex. 9 | ⊙ | ⊙ | ○ | 1.30 | |
| Ex. 10 | ⊙ | ○ | ⊙ | 1.40 | |
| Ex. 11 | ⊙ | ○ | ○ | 1.41 | |
| Ex. 12 | ⊙ | ○ | ⊙ | 1.38 | |
| Ex. 13 | ⊙ | ○ | ⊙ | 1.29 | |
| Ex. 14 | ○ | ⊙ | ○ | 1.37 | |
| Ex. 15 | ○ | ○ | ○ | 1.36 | |
| Ex. 16 | ⊙ | ⊙ | ⊙ | 1.41 | |
| Ex. 17 | ○ | ⊙ | ○ | 1.43 | |
| Ex. 18 | ⊙ | ○ | ○ | 1.37 | Slightly depends on the environment |

TABLE 2-continued

| | Letter Fattening | Surface Roughness of Halftone Image | Halftone Image | Image Density | Others |
|---|---|---|---|---|---|
| Ex. 19 | ○ | ○ | ○ | 1.35 | |
| Ex. 20 | ○ | ⊙ | ○ | 1.30 | |
| Ex. 21 | ⊙ | ⊙ | ⊙ | 1.31 | |
| Ex. 22 | ○ | ⊙ | ○ | 1.36 | Slight background fouling |
| Ex. 23 | ○ | ○ | ○ | 1.45 | |
| Ex. 24 | ⊙ | Δ | ○ | 1.42 | |
| Ex. 25 | ○ | ⊙ | ⊙ | 1.33 | Slight background fouling |
| Ex. 26 | ○ | ○ | Δ | 1.40 | |
| Ex. 27 | ○ | ⊙ | ⊙ | 1.43 | |
| Ex. 28 | ⊙ | ○ | ○ | 1.36 | |
| Com. Ex. 1 | ○ | Δ | ○ | 1.40 | |
| Com. Ex. 2 | Δ | X | Δ | 1.37 | |
| Com. Ex. 3 | Δ | Δ | Δ | 1.15 | Largely depends on the environment |
| Com. Ex. 4 | Δ | Δ | Δ | 1.17 | Slightly depends on the environment |

The evaluation results of the 300,000$^{th}$ images are shown in Table 3.

◎ represents excellent, ○ represents no problem in practical use, Δ represents acceptable and X represents unusable.

TABLE 3

| | Letter Fattening | Surface Roughness of Halftone Image | Halftone Image | Image Density | Others |
|---|---|---|---|---|---|
| Ex. 1 | ◎ | ◎ | ◎ | | |
| Ex. 2 | ◎ | ◎ | ◎ | | |
| Ex. 3 | ◎ | ◎ | ◎ | | |
| Ex. 4 | ◎ | ◎ | ◎ | | |
| Ex. 5 | ◎ | ◎ | ○ | | |
| Ex. 6 | ○ | ◎ | Δ | | |
| Ex. 7 | ○ | Δ | ◎ | | |
| Ex. 8 | ○ | ◎ | ○ | | |
| Ex. 9 | ○ | ◎ | Δ | | |
| Ex. 10 | ◎ | ○ | ○ | | |
| Ex. 11 | ◎ | Δ | Δ | | |
| Ex. 12 | ○ | ○ | ○ | | |
| Ex. 13 | ○ | ○ | Δ | | |
| Ex. 14 | ○ | Δ | ○ | | |
| Ex. 15 | ○ | ○ | Δ | | |
| Ex. 16 | ○ | ○ | ◎ | | |
| Ex. 17 | ○ | ○ | Δ | | |
| Ex. 18 | ◎ | Δ | ○ | | Slightly depends on the environment |
| Ex. 19 | Δ | ○ | Δ | | |
| Ex. 20 | ○ | ○ | ○ | | |
| Ex. 21 | ◎ | ◎ | ◎ | | |
| Ex. 22 | ◎ | ◎ | ◎ | | |
| Ex. 23 | ○ | ○ | Δ | | |
| Ex. 24 | ◎ | Δ | Δ | | |
| Ex. 25 | Δ | ◎ | ◎ | | |
| Ex. 26 | ○ | ○ | Δ | | |
| Ex. 27 | ○ | ○ | ◎ | | Slight background fouling |
| Ex. 28 | ◎ | ○ | Δ | | |
| Com. Ex. 1 | X | X | Δ | | |
| Com. Ex. 2 | Δ | X | X | | |
| Com. Ex. 3 | X | X | X | | Largely depends on the environment |
| Com. Ex. 4 | Δ | X | Δ | | Slightly depends on the environment |

As is clear from Tables 2 and 3, both the initial and 300,000$^{th}$ images in Examples 1 to 28 were acceptable. However, the surface roughness of the initial halftone image in Comparative Example 2 was a problem in practical use, and the initial images in Comparative Examples 1, 3 and 4 were initially acceptable, but the 300,000$^{th}$ images thereof were all unusable.

This application claims priority and contains subject matter related to Japanese Patent Application No. 2004-057462 filed on Mar. 2, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A carrier composition, comprising:

a particulate magnetic material; and a layer located on a surface of the particulate magnetic material, wherein the layer comprises a composition formed by heating a mixture comprising:

a metal alkoxide;

a resin having a hydroxyl group reactive with the metal alkoxide; and a particulate inorganic material.

2. The carrier composition of claim 1, wherein the metal alkoxide comprises at least one metal selected from the group consisting of aluminum and titanium.

3. The carrier composition of claim 1, wherein the resin having a hydroxyl group comprises at least one unit obtained from at least one monomer selected from the group consisting of hydroxyalkyl acrylate and hydroxyalkyl methacrylate.

4. The carrier composition of claim 1, wherein a molar concentration of the metal alkoxide in the layer is larger than a molar concentration of the hydroxyl group of the resin in the layer.

5. The carrier composition of claim 1, wherein the mixture forming the layer further comprises a silicone resin.

6. The carrier composition of claim 5, wherein the silicone resin comprises a unit having the following formula (1):

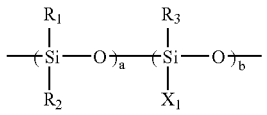

(1)

wherein $R_1$ to $R_3$ each, independently, represent a hydrocarbon group or a derivative thereof; $X_1$ represents a condensation reaction group; and a and b represent integers.

7. The carrier composition of claim 1, wherein the particulate inorganic material comprises alumina, titania, silica or a mixture thereof.

8. The carrier composition of claim 1, wherein the particulate inorganic material has a weight-average particle diameter of from 0.15 to 2.0 μm.

9. The carrier composition of claim 1, wherein the particulate inorganic material forms concavities and convexities on a surface of the carrier, wherein an average difference in height and depth between the concavities and convexities is from 0.1 to 2.0 μm.

10. The carrier composition of claim 1, wherein the layer has an average thickness of from 0.1 to 0.6 μm.

11. The carrier composition of claim 1, wherein a weight-average particle diameter (D) of the particulate inorganic material and a thickness of the layer (h) satisfy the following relationship:

$$1<D/h<10.$$

12. The carrier composition of claim 1, wherein the mixture forming the layer further comprises at least one of a particulate electroconductive material or a particulate semiconductive material.

13. The carrier composition of claim 1, wherein a resistivity R of the carrier is from $1.0\times10^9$ to $1.0\times10^{11}$ Ω·cm when measured by a method in which an AC voltage having a peak voltage (E) is applied at a frequency of 1,000 Hz to a magnetic brush of the carrier formed in a gap of d mm between parallel plate electrodes, and wherein the magnetic brush has a space occupancy of 40%, and the peak voltage (E) is represented by the following formula (2):

$$E\ (V)=250\times d \qquad (2)$$

wherein d is 0.40±0.05 mm.

14. The carrier composition of claim 1, wherein the mixture forming the layer further comprises a coupling agent having an amino group.

15. The carrier composition of claim 14, wherein the coupling agent is an amino silane coupling agent.

16. A developer comprising:

the carrier according to claim 1; and a negatively charged toner comprising:

toner particles comprising:

a binder resin;

a colorant; and a fluidizer serving as an external additive, wherein the toner has a weight-average particle diameter of from 3 to 10 μm, an average circularity of from 0.93 to 1.00.

17. The developer of claim 16, wherein the fluidizer is present in an amount of from 0.5 to 3.0% by weight of toner particles.

18. The developer of claim 16, wherein the toner has a charge quantity not less than 15 μC/g as an absolute value.

19. The developer of claim 16, wherein the toner is present in an amount of from 2 to 12% by weight of developer.

20. A process cartridge detachable from an image forming apparatus, comprising:

an image bearer configured to bear an electrostatic latent image thereon;

a friction charger configured to frictionize the developer according to claim 16 to negatively charge the toner; and an image developer comprising a rotatable holder including a magnetic field generator therein, said rotatable holder being configured to hold the developer including the negatively charged toner and develop the electrostatic latent image with the developer.

21. The process cartridge of claim 20, further comprising a container configured to contain the negatively charged toner.

22. An image forming apparatus comprising:

an image bearer;

a charger configured to charge an image bearer;

a latent image former configured to form an electrostatic latent image on the image bearer;

an image developer configured to develop the electrostatic latent image with the developer according to claim 16 to form a toner image thereon;

a transferer configured to transfer the toner image onto a transfer sheet;

a fixer configured to fix the toner image on the transfer sheet; and a cleaner configured to clean a surface of the image bearer.

* * * * *